US012410694B2

(12) United States Patent
Wensrich et al.

(10) Patent No.: US 12,410,694 B2
(45) Date of Patent: Sep. 9, 2025

(54) DOWNHOLE SETTING TOOL AND METHOD OF USE

(71) Applicant: BN Technology Holdings Inc., Houston, TX (US)

(72) Inventors: Jeffrey Wensrich, Houston, TX (US); Sam Schroit, Houston, TX (US)

(73) Assignee: BN TECHNOLOGY HOLDINGS INC., Houston, TX (US)

( * ) Notice: Subject to any disclaimer, the term of this patent is extended or adjusted under 35 U.S.C. 154(b) by 37 days.

(21) Appl. No.: 18/691,028

(22) PCT Filed: Sep. 12, 2022

(86) PCT No.: PCT/US2022/043247
§ 371 (c)(1),
(2) Date: Mar. 11, 2024

(87) PCT Pub. No.: WO2023/039258
PCT Pub. Date: Mar. 16, 2023

(65) Prior Publication Data

US 2024/0401448 A1 Dec. 5, 2024

Related U.S. Application Data

(60) Provisional application No. 63/243,603, filed on Sep. 13, 2021.

(51) Int. Cl.

| | |
|---|---|
| ***E21B 43/12*** | (2006.01) |
| ***E21B 33/12*** | (2006.01) |
| ***E21B 33/127*** | (2006.01) |
| ***E21B 43/38*** | (2006.01) |

(52) U.S. Cl.
CPC ..... *E21B 43/128* (2013.01); *E21B 33/1275* (2013.01); *E21B 43/38* (2013.01)

(58) Field of Classification Search
CPC ..... E21B 43/128; E21B 43/38; E21B 33/1275
See application file for complete search history.

(56) References Cited

U.S. PATENT DOCUMENTS 4,378,051 A * 3/1983 Cholet ..... E21B 23/00 166/383
5,398,753 A * 3/1995 Obrejanu ..... E21B 23/042 294/86.18

(Continued)

FOREIGN PATENT DOCUMENTS

CA 2951658 C * 1/2019 ..... E21B 23/06
CA 3231521 A1 * 3/2023 ..... E21B 23/06

(Continued)

*Primary Examiner* — Aaron L Lembo

(57) ABSTRACT

A system and method of use are disclosed that enable a simplified operational procedure of isolating portions of a well bore. Specifically, a self-venting setting tool is described, that in an embodiment, utilizes well bore fluid as the inflation fluid for a downhole packing device. Simply exposing the tool to a pressure greater than atmospheric pressure readies the system for the setting of downhole packing devices. Otherwise, a typical system may be required to undergo a complex venting procedure prior to deployment or be susceptible to failure due to gas regions within the wellbore prior to reaching a desired location for the subsequent wellbore isolation.

20 Claims, 21 Drawing Sheets

(56) References Cited

U.S. PATENT DOCUMENTS 5,947,198 A * 9/1999 McKee ..... E21B 17/206 166/66.4
6,012,518 A * 1/2000 Pringle ..... E21B 41/00 166/66.4
6,112,809 A * 9/2000 Angle ..... E21B 47/26 175/45
6,142,237 A * 11/2000 Christmas ..... E21B 17/06 166/66.4
6,196,325 B1 * 3/2001 Connell ..... E21B 17/041 166/242.6
6,213,202 B1 * 4/2001 Read, Jr. ..... E21B 17/06 166/242.6
6,582,145 B1 * 6/2003 Malone ..... E21B 33/122 403/31
6,715,554 B1 * 4/2004 Cunningham ..... E21B 33/047 166/368
7,458,423 B2 * 12/2008 Vercaemer ..... E21B 43/11 166/227
7,540,327 B2 * 6/2009 Billingham ..... E21B 41/00 166/55.7
7,607,477 B2 * 10/2009 Stoesz ..... G02B 6/52 166/242.6
7,661,477 B2 * 2/2010 Sheiretov ..... E21B 17/1021 166/301
7,878,244 B2 * 2/2011 Nold, III ..... E21B 49/10 166/264
8,591,200 B2 * 11/2013 Marica ..... F04B 5/00 417/388
9,664,004 B2 * 5/2017 Martinez ..... E21B 23/00
10,190,389 B2 * 1/2019 Bane ..... E21B 23/0421
10,920,587 B2 * 2/2021 Yuratich ..... E21B 49/10
11,156,057 B2 * 10/2021 Wensrich ..... E21B 34/08
11,332,984 B2 * 5/2022 Mahbod ..... E21B 17/1071
11,428,066 B2 * 8/2022 Andersen ..... E21B 43/26
11,608,697 B2 * 3/2023 Schroit ..... H02K 7/116
11,719,084 B2 * 8/2023 Wensrich ..... E21B 33/12 166/308.1
11,761,314 B2 * 9/2023 Schroit ..... F04B 17/03 166/377
11,788,372 B2 * 10/2023 Andersen ..... E21B 29/02 166/297
12,037,858 B2 * 7/2024 Hallundbaek ..... F04B 53/16
12,105,226 B2 * 10/2024 Schroit ..... G01S 7/497
12,146,384 B2 * 11/2024 Quero ..... E21B 34/063
2008/0190605 A1 * 8/2008 Clapp ..... E21B 49/087 166/185
2009/0025926 A1 * 1/2009 Briquet ..... E21B 49/10 166/242.6
2009/0229817 A1 * 9/2009 Partouche ..... E21B 17/028 166/242.6
2011/0315403 A1 * 12/2011 Nard ..... E21B 33/128 166/387
2013/0000887 A1 * 1/2013 Smith ..... E21B 33/1216 166/179
2015/0285042 A1 * 10/2015 Porel ..... F04B 17/03 417/399
2016/0145958 A1 * 5/2016 Richards ..... E21B 23/0412 166/65.1
2019/0242209 A1 * 8/2019 Anthony ..... E21B 33/128
2021/0355760 A1 * 11/2021 Mahbod ..... E21B 17/1014

FOREIGN PATENT DOCUMENTS

GB 2386143 A * 9/2003 ..... E21B 23/00
GB 2451767 A * 2/2009 ..... E21B 43/128

* cited by examiner

DOWNHOLE SETTING TOOL AND METHOD OF USE

CROSS-REFERENCE TO RELATED APPLICATIONS

This application claims the benefit of priority of U.S. Provisional Patent Application Ser. No. 63/243,603 filed on Sep. 13, 2021; the application being incorporated by reference herein.

BACKGROUND OF THE INVENTION

The present disclosure relates generally to a method of providing wellbore fluid to effectuate a change in a downhole tool. Specifically, the method of the present invention relates to setting an inflatable packing device, packer or plug at a location in a wellbore, and an apparatus or assembly usable for performing the method.

BACKGROUND OF THE RELATED ART

A bottom hole assembly (BHA) is an apparatus that is adapted for use within a wellbore that extends into the earth to reach a target subterranean formation that is expected to contain valuable hydrocarbons, such as oil, gas and combinations thereof. A bottom hole assembly may be run into an existing wellbore on a wireline that may provide a physical tether as well as providing connections for electrical power delivery and data communication between the bottom hole assembly and a computer system at the surface near the wellbore. Furthermore, a bottom hole assembly may include one or more downhole tools, components or subsystems that perform one or more functions of the bottom hole assembly.

Certain downhole tools may include a pump. A downhole tool comprising a pump may be activated to provide pressurized fluid to a subsystem within the downhole tool or elsewhere within the BHA.

Many downhole tools are actuated or operated in response to the application of pressurized fluid. Examples of these devices include hydraulically set packers and liner hangers, pressure actuated perforating gun firing heads, inflatable plugs and inflatable packers. In all these devices, the application of pressurized fluid, to the downhole tool, effectuates a change in the downhole tool. Inflatable packing down hole tools such as packers, plugs, bridge plugs, and the like, are commonly utilized in the operation or maintenance of subterranean wells. These inflatable packing devices normally comprise an inflatable elastomeric balder concentrically disposed around a central body portion such as a tube or mandrel. Typically, a sheath of reinforcing slats or ribs is concentrically disposed around the balder and thick-walled elastomeric packing cover is concentrically disposed around at least a central portion of the sheath. Such inflatable packing downhole tools may be deployed in a wellbore by using tubing, a downhole electric wireline or a slick line to support the down hole tool and to lower the down hole tool to a location in the wellbore. Typically, the inflatable packing down hole tool is connected to the electric wire line or slick line at the bottom of a downhole hole tool comprising a pump, which may be known as a setting tool. A BHA of these components may be lowered into the wellbore at a location below the extent of the production tubing and the setting tool may provide pressurized fluid from the wellbore to the inflatable packing downhole tool. The setting tool may intake fluid from within the well, pressurize the fluid and deliver the fluid to the inflatable packer. Alternatively, the inflation fluid may be transported to the vicinity of the inflatable packing device and then pumped into the inflatable packer by the setting tool. After the inflatable packing device is sufficiently inflated to contact and seal the wellbore, it is released from the electric wireline or slick line, and the electric wireline or slick line is retrieved from the wellbore. In this manner, the bottom hole assembly may be used to isolate portions of the wellbore for water-shut off, pressure isolation, sand isolation; or in conjunction with a formation fracturing process, formation treatment process, other processes, or other downhole operations.

Current state of the art setting tools which utilize wellbore fluid as the pumping fluid to effectuate a change in inflatable packing downhole tools, i.e. inflate, require a complicated gas venting procedure prior to deploying the BHA into a wellbore. This is required to ensure that when the pump is activated downhole, it provides fluid at pressure to the inflatable packing downhole tool. The setting tools which require venting prior to deployment are also susceptible to having the pump system displaced with gas during deployment to a desired location in the wellbore, for example, when deploying through a region of high-pressure gas. When this occurs, the tool must be brought to surface and the venting procedure repeated.

Therefore, an improved downhole setting tool, a self-venting downhole setting tool, is disclosed herein, which automatically vents when exposed to a wellbore fluid which may be provided to the inflatable packing downhole tool.

BRIEF SUMMARY

The primary purpose of the invention disclosed herein is an improved down hole setting tool for inflating and/or setting an inflatable packing downhole tool or packer in a wellbore. Additionally, an improved method of inflating and/or setting an inflatable packing downhole tool or packer in a wellbore is disclosed.

A BHA comprising a self-venting setting tool downhole tool (which hereinafter may be referred to as the downhole tool or the self-venting setting tool) and an inflatable packer down hole tool is lowerable into a wellbore and is operable to set an inflatable plug or packer therein. The downhole tool is releasably connected to the inflatable packer down hole tool and includes a pump that is fluidically connected with the inflatable packer downhole tool and operable to inflate the packer. A filter module is disposed on the downhole end of the downhole tool and includes an intake fluid passageway that has an inlet in fluid communication with a fluid in the wellbore and a pump intake chamber of the downhole tool. A fluid communication passageway, known as a vent passageway, is provided in fluid communication from the pump intake chamber to the wellbore, for the purpose of evacuating a gas (e.g. air or other gases typically found in a downhole wellbore environment) from the pump intake chamber during the deployment of the BHA and/or during operation of the downhole tool pump. The vent passageway preferably only allows gas out of the pump intake chamber to the wellbore and no fluid into the pump intake chamber from the wellbore. For example, with a ball check valve, flapper valve, restrictor or the like. The vent passageway may however, allow wellbore fluid to enter the pump intake chamber during deployment of the BHA and/or during operation of the downhole tool pump.

In an embodiment, the downhole tool comprises a controller module, compensator module, power module, drive sub, pump module, intake sub and filter module. The pump resides in a pump intake chamber of the pump module, receives mechanical power from the above power module and through the drive sub. The drive sub is mechanically secured to the uphole end of the pump module and provides a fluid communication passageway, the vent passageway, from the pump intake chamber to the wellbore. The intake sub is mechanically secured to the downhole end of the pump module and the uphole end of the filter module and provides a fluid communication passageway from the filter module to the pump intake chamber. An output fluid passageway is provided from the pump outlet, thought the intake sub and through the filter module.

In another embodiment, a bottom hole assembly (BHA) comprises the self-venting setting tool and an isolation tool, for example, an inflatable packer downhole tool.

In a further embodiment, there is provided a method of isolating a portion of the wellbore, the method comprising the steps of: deploying the BHA on wireline; venting gas residing in and/or entering the pump intake chamber during deployment or operation, from the wellbore or inflatable packer downhole tool; positioning the BHA at a desired location in the wellbore; activating the downhole tool to provide fluid to the isolation tool; pressurizing the isolation tool to engage the wellbore; isolating a portion of the wellbore above the isolation tool from a portion of the wellbore below the isolation tool; disconnecting the downhole tool from the isolation tool and removing the downhole tool from the wellbore.

DETAILED DESCRIPTION

Figure 1:
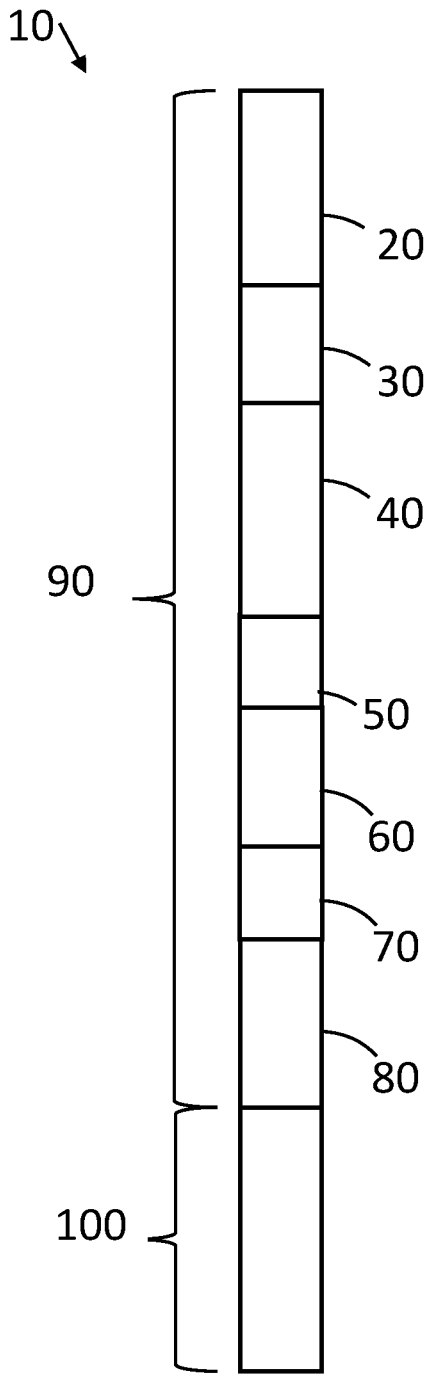
FIG. 1 is a block diagram of the modules of a bottom hole assembly including a self-venting setting tool.

An embodiment provides a self-venting setting tool downhole tool (which hereinafter may be referred to as the downhole tool or the self-venting setting tool) for use within a wellbore that extends into a subterranean formation. The downhole tool may be part of a bottom hole assembly comprised of other downhole tools or components. The self-venting setting tool may be connected to a wireline that extends from a wireline unit or truck located near an opening into the wellbore. The wireline may be used to provide physical support of the downhole tool as it is raised and lowered into and within the wellbore, supply electrical power to electronic components within the downhole tool, and/or provide for data communication between the downhole tool and control systems outside the wellbore. While the wireline may be sufficient for raising and lowering the downhole tool within a substantially vertical wellbore or portion of a wellbore, a downhole tool on a wireline as a part of a BHA may further include a tractor that can push or pull the downhole tool along the wellbore regardless of the orientation of the wellbore, such as in a horizontal portion of a wellbore.

In an embodiment, the self-venting setting tool comprises a controller module electrically connected to the wireline, a compensator module, a power module comprising an electrical motor, a drive sub, pump module, intake sub and a fluid source module including a fluid source.

The pump module is comprised of a pump module housing and a pump which resides in a pump intake chamber such that when it receives mechanical power from the motor within the power module by a drive shaft which extends through the drive sub and supported by bearings, it draws in fluid from the pump intake chamber. The pump may have one or pump intake ports and a pump output. The drive shaft additionally extends through a rotary seal which retains oil within the uphole power module and compensator module, and is coupled to the shaft of the pump. The drive sub is mechanically secured to the uphole end of the pump module housing, secures the pump and provides one or more fluid communication passageways from the pump intake chamber to the wellbore, vent passageways.

The intake sub is mechanically secured to the downhole end of the pump module and the uphole end of the fluid source module and provides one or more fluid communication passageways from the fluid source module to the pump intake chamber. An output fluid passageway, which may also be referred to as the output side of the downhole tool is comprised of an output tube and a passage within the intake sub and a bottom sub, is provided from the pump outlet.

The fluidically connected passageways from and including the fluid source module to pump intake ports, may collectively be referred to as the intake side of the downhole tool.

In an alternative embodiment, the fluid source module is positioned above the pump module within the self-venting setting tool.

In an alternative embodiment, the fluid source module is secured to the uphole end of the pump module and on the downhole end of the drive sub.

The intake of the one or more vent passageways from the pump intake chamber, vent passageway intakes, are preferably located uphole from the pump intake ports. In this way, having accumulated gas at or near the pump intake ports is avoided.

In an embodiment, the downhole tool is void of a fluid source module and when the pump is activated, fluid is drawn into the pump module through one or more passageways fluidically connected to the wellbore, which may additionally function as vent passageways when the self-venting setting tool is exposed to wellbore pressure greater than atmospheric pressure.

The power module comprising the electrical motor may include a speed reducing gearbox and is disposed to receive power and communication signals from a control module. The electric motor preferably receives electrical power through a wireline cable but may receive some or all its electrical power from a battery within the BHA.

The control module comprises a controller in electronic communication with the power module for receiving a current signal form the electrical motor and is in electronic communication with electrical motor for sending a control signal to the electrical motor. The controller may, for example, control the operation of the electrical motor to maintain a desired rotational speed of the pump the power module powers, thereby controlling the flowrate of the self-venting setting tool. Additionally, the controller may, for example, control the operation of the electrical motor to maintain a desired torque of the pump the power module powers, thereby controlling the pressure output of the self-venting setting tool.

The controller may be an analog circuit or a digital processor, such as an application specific integrated circuit (ASIC) or array of field-programmable gate arrays (FPGAs). Accordingly, embodiments may implement any one or more aspects of control logic in the controller that is on-board the downhole tool or in a computing system that is in data communication with the controller. A computing system may be located at the surface to provide a user-interface for monitoring and controlling the operation of the downhole tool and may be in data communication with the controller over the wireline cable. The control module preferably receives electrical power through a wireline cable but may receive some or all of its electrical power from a battery within the BHA.

In an embodiment the pump is a fixed displacement pump.

In an embodiment the pump is variable displacement pump.

In an embodiment the pump is an axial piston pump.

In an embodiment the pump is an external gear pump.

In an embodiment the pump is a gerotor pump.

In an embodiment the pump is an internal gear pump.

In an embodiment the pump is a radial piston pump.

In an embodiment the pump is a screw pump.

In an embodiment the pump is a swash plate pump.

In an embodiment the pump is a vane pump.

In an embodiment, the drive sub is void of vent passageways and alternatively the pump module housing comprises one or more vent passageways uphole from the pump intake ports.

In an embodiment, the pump housing comprises one more vent passageways disposed to vent gas from within the pump and output hydraulic passageway to the pump intake chamber or wellbore.

In an embodiment, the pump module housing also functions as the pump housing, the pump housing mechanically secured to a sub on an uphole end and mechanically secured to the intake sub on the downhole end, the pump disposed to receive mechanical power from the power module.

In an embodiment a fluid control device is disposed to control fluid through the vent passageways.

In an embodiment, a fluid control device is located on the one or more vent passageways to predominantly allow fluid flow in one direction, from the pump intake chamber to the wellbore.

In an embodiment the fluid control device is a ball check valve.

In an embodiment, the fluid control device is a flapper valve.

In an embodiment the fluid control device is an umbrella valve.

In another embodiment, the fluid control device is a mesh screen, and is provided along the vent passageways to allow fluid flow from the wellbore to the pump intake chamber and gas to flow from the pump intake chamber to the wellbore, while limiting the size of particulate that may be carried into the pump intake chamber by the fluid.

In an embodiment, a ported screw is provided along the one or more vent passageways to allow fluid flow from the wellbore to the pump intake chamber and gas to flow from the pump intake chamber to the wellbore.

In an embodiment, the ported screw is a restrictor.

In a preferred embodiment, the one or more vent passageways are in fluid communication with the wellbore above the bottom hole assembly.

In a preferred embodiment, a wireline bottom hole assembly is provided for use within a wellbore that extends into a subterranean formation, comprising: a downhole tool having a pump module including a pump, a pump intake port and a pump output; a fluid source module disposed below the pump and in fluid communication with the wellbore above the bottom hole assembly, having a ported housing and a first fluid volume; the pump intake port disposed to intake fluid from the fluid source module; an electric motor operable to power the pump; a vent passageway in fluid communication with the pump, having a vent passageway intake on an uphole side of the pump intake port and disposed to vent fluid from the pump module to the wellbore; an output passageway extending from the pump output, through the fluid source module.

In a preferred embodiment, the fluid source module is a filter module; the filter module comprising a ported housing, a filter which may be known as a filter cartridge, and a flow-through tube. The ported housing allows fluid communication with the wellbore fluid residing exterior to the ported housing, such that fluid may flow from the wellbore through the ported housing into a first fluid volume being an outer annular volume, through the filter and into a second fluid volume being an inner annular fluid volume. The flow-through tube enables fluid communication from the pump through the filter module and bottom sub connected thereto. In this embodiment, the one or more fluid communication passageways of the intake sub extend from the second fluid volume, the inner annular fluid volume of the to the pump intake chamber such that when the pump is activated, fluid is drawn into the pump by the one or more pump intake ports form the wellbore, through the filter and provided to the output side of the self-venting setting tool. The filter may be a mesh screen selected to limit the size of a particulate within the fluid passing therethrough.

In the preferred embodiment, the output passageway comprises the flow-through tube enabling fluid communication from the pump, out of the downhole end of the fluid source module.

In an embodiment, wherein the fluid source module is a filter module, the filter module comprises a filter disposed interior the first fluid volume and the ported housing; a second fluid volume within the filter, wherein the second fluid volume is in fluid communication with a pump intake port.

In a preferred embodiment, the filter module is in fluid communication with the wellbore above the bottom hole assembly.

In an embodiment, the filter module is only in fluid communication with the wellbore above the bottom hole assembly and the intake side of the downhole tool.

In an embodiment, the filter module is only in fluid communication with the wellbore above the bottom hole assembly, the intake side of the downhole tool and the output side of the downhole tool.

In an embodiment, the fluid source module is a ported module comprising a ported housing, an inner fluid volume, a bottom sub and a flow through tube enabling fluid communication from the pump, through the ported module and bottom sub.

In an embodiment, the fluid source module is a reservoir module and the self-venting setting tool is disposed therein. In this embodiment, fluid may alternatively vent to the interior of the reservoir module via the vent passageways. The reservoir module comprises; a reservoir outer housing, a reservoir inner body isolating reservoir fluid within the reservoir outer housing from well fluid allowed to communicate through one or more ports in the reservoir outer housing. As fluid is drawn into the pump intake chamber by the pump and fluid is provided out of the self-venting setting tool through a bottom adapter of the reservoir module secured to the downhole end of the self-venting setting tool, wellbore pressure acts on the reservoir inner body through the one or more ports in the reservoir outer housing to provide wellbore pressure to the pump intake chamber.

In an embodiment, a portion of the self-venting setting tool is disposed within the reservoir module such that the interior of the reservoir module is fluidically connected to the pump intake chamber or pump module.

In an embodiment, the reservoir module is above the pump intake chamber and one or more fluid passages fluidically connect the reservoir module with the pump intake chamber or the pump module.

In an embodiment, the self-venting setting tool is void of a fluid source module Statements made herein referring to a component, opening or port being "above", "below", "uphole" or "downhole" relative to another component, opening or port should be interpreted as if the downhole tool or bottom hole assembly has been run into a wellbore. It should be noted that even a horizontal wellbore, or any non-vertical well bore, still has an "uphole" direction defined by the path of the wellbore that leads to the surface and a "downhole" direction that is generally opposite to the "uphole" direction.

An embodiment provides a method of delivering fluid out of bottom hole comprising a self-venting setting tool downhole tool including a pump, the method comprising: deploying the bottom hole assembly within a wellbore that extends into a subterranean formation; exposing the bottom hole assembly to a wellbore fluid pressure above atmospheric pressure; allowing fluid to enter the bottom hole assembly and sufficiently displace gas within an intake side of the downhole tool by venting the gas through one or more vent passageways to the wellbore; activating the pump; the pump intaking fluid form a fluid source in fluid communication with the wellbore.

In an embodiment the bottom hole assembly is deployed via wireline.

In an embodiment, the method further comprises displacing gas within an output side of the self-venting setting tool downhole tool.

In an embodiment, the method includes displacing gas with fluid from a fluid source module.

In an embodiment, the method further comprises activating the pump after displacing and venting gas within the intake side of the self-venting setting tool and prior to displacing and venting gas from the output side of the self-venting setting tool.

In an embodiment, the method further comprises activating the pump after displacing and venting gas from within the intake side and output side of the self-venting setting tool.

In an embodiment, the method further comprises venting gas through one or more fluid control devices disposed along the vent passageways.

In an embodiment, the method further comprises venting gas through one or more mesh screens disposed along the one or more vent passageways to allow fluid flow from the wellbore to the interior of the self-venting setting tool. The mesh screen selected to control the size of a particulate within the fluid passing therethrough.

In a preferred embodiment of the method, the fluid source includes a ported housing, a filter and a fluid volume; the fluid volume in fluid communication with the pump, and the wellbore above the bottom hole assembly through the filter and the ported housing.

In an embodiment, there is provided a method of isolating a portion of the wellbore, the method comprising the steps of: deploying a bottom hole assembly on a wireline into a wellbore; the bottom hole assembly comprising a downhole tool and an isolation tool fluidically connected thereto, and a fluid source; the downhole tool including a pump; exposing the downhole tool to a fluid pressure; displacing gas within an intake side of the downhole tool; venting gas through one or more vent passageways to the wellbore by allowing fluid to enter downhole tool and sufficiently displace gas therein; positioning the bottom hole assembly at a desired location in the wellbore; activating the self-venting setting tool to provide fluid to the isolation tool from the fluid source; pressurizing the isolation tool to engage the wellbore wall; isolating a portion of the wellbore above the isolation tool from a portion of the wellbore below the isolation tool.

In a preferred embodiment, the fluid pressure is greater than atmospheric pressure.

In a preferred embodiment, the fluid source is a filter module.

In an embodiment, the gas is displaced with fluid from the filter module.

In an embodiment, the method further comprises the self-venting setting tool automatically venting gas through one or more vent passageways to the wellbore by providing fluid from the fluid source to the output hydraulic passageway, the output side of the self-venting setting tool, after activation of the self-venting setting tool.

In an embodiment, the method further comprises venting gas through one or more fluid control devices disposed along the one or more vent passageways.

In an embodiment, the method further comprises disconnecting self-venting setting tool from the isolation tool and removing the self-venting setting tool from the wellbore.

In an embodiment of the method wherein the gas is displaced with fluid from the filter module, the filter module comprises; a ported housing, a filter and a fluid volume in fluid communication with the pump, and the wellbore above the bottom hole assembly through the filter and the ported housing.

In an embodiment, the one or more fluid control devices is one or more restrictors.

In an embodiment of the method, the isolation tool is an inflatable plug.

In an embodiment of the method, the isolation tool is an inflatable packer.

In and embodiment of the method wherein the fluid source is a filter module, the filter module additionally comprises a flow-through tube enabling fluid communication from the pump, out of the downhole end of the self-venting setting tool.

In an embodiment of the method, the fluid source is a reservoir module comprising a reservoir outer housing, a reservoir inner body isolating reservoir fluid within the reservoir outer housing from well fluid allowed to communicate through one or more ports in the reservoir outer housing.

In an embodiment, the fluid source is a fluid volume filtered by a filter and in fluid communication with the wellbore.

In an embodiment, the fluid source is a volume of fluid in the interior of a filter, the volume fluidically connected to the wellbore fluid exterior to the self-venting setting tool.

In an embodiment, the fluid source is a fluid volume in the interior of a ported housing in fluid communication with the wellbore.

In an embodiment, the fluid source is fluid in a reservoir module.

In an embodiment, the fluid source is a fluid volume in the interior of a reservoir module provided with fluid prior to deployment within a wellbore.

In an embodiment of a method wherein the fluid source module is a reservoir module, the method further comprises supplying the reservoir module with fluid prior to the deployment step.

FIG. 1 is a diagram of a bottom hole assembly (BHA) 10 comprising a self-venting setting tool 90 (the downhole tool) disposed to pressurize an isolation tool 100. The self-venting setting tool comprises a control module 20 disposed to send and receive signals from other modules of the self-venting setting tool 90 including signals to and from a power module 40 located below the control module 20. A compensator module 30 is located above the power module 40 and below the control module 20. The power module 40 converts electrical power into mechanical power and transmits the mechanical power through a below mounted drive sub 50 to a pump module 60. Fluid is supplied to the pump module 60 from a fluid source module 80 and through intake sub 70. Fluid from the pump module 60 is delivered through the intake sub 70, through the fluid source module 80 and to the isolation tool 100.

Figures 2A, 2B, 2C:
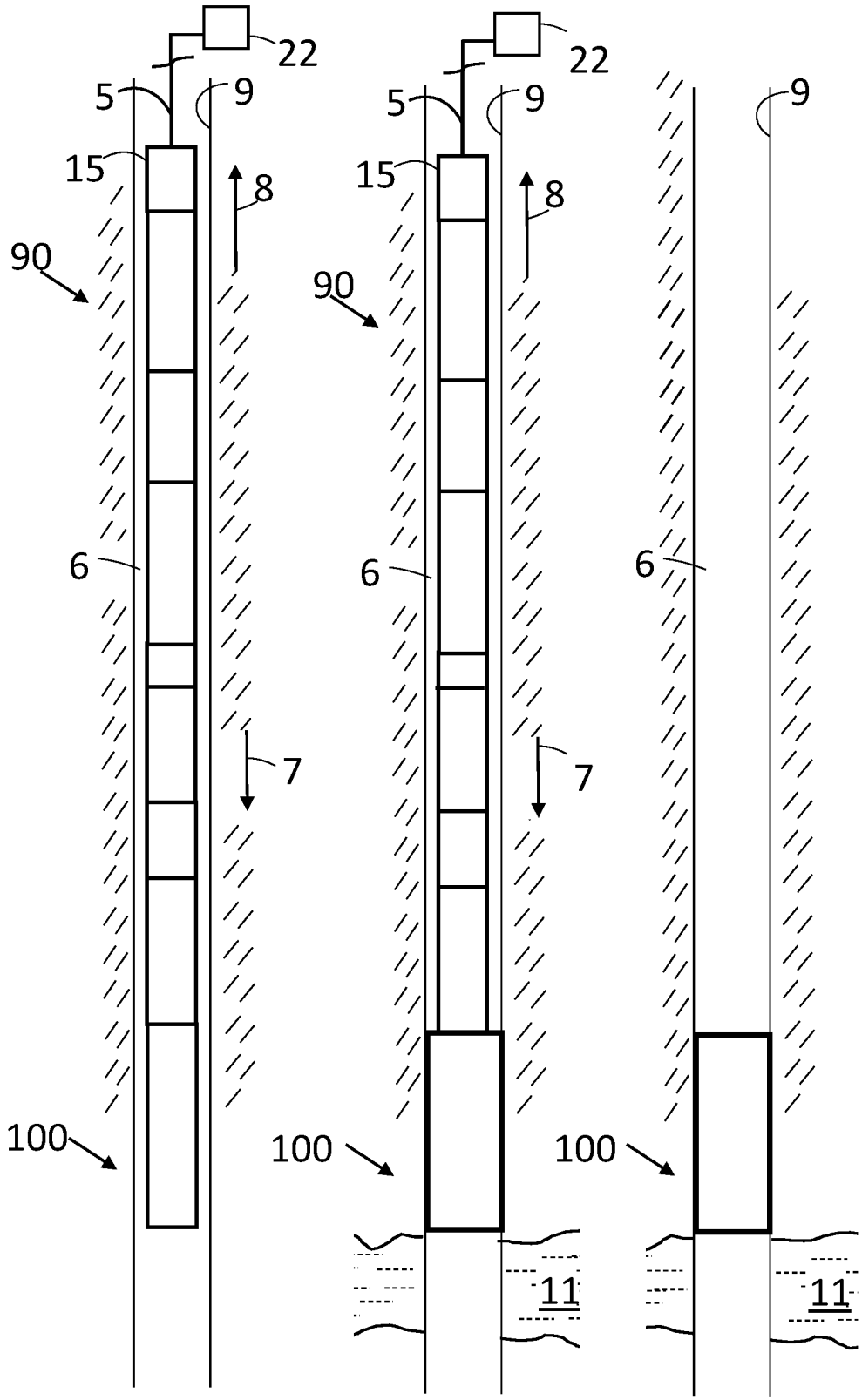
FIGS. 2A-C are diagrams of a bottom hole assembly, the bottom hole assembly including a self-venting setting tool and an isolation tool being run into a wellbore on a wireline, the isolation tool in the wellbore set to isolate a wellbore region above the isolation tool from a portion of wellbore below the isolation tool and the isolation tool left in the wellbore.

In FIG. 2A, the BHA 10 is disposed in a wellbore 6 with the wireline cable 5 coupled to the tool 90 via a cable head 15. The cable is coupled to a truck or unit (not shown) at the surface above the wellbore 6. The wireline cable 5 may provide physical support to the self-venting setting tool 90, supply electrical power to the self-venting setting tool 90, and enable data communication between the self-venting setting tool 90 and a computing system 22 at the surface above the wellbore 6. The arrow 8 illustrates an uphole direction and the arrow 7 illustrates a downhole direction defined by the wellbore passageway to the surface.

In FIG. 2B, the BHA 10 has been run into the wellbore 6 to a location where the isolation tool 100 is above target subterranean formation 11. In this location, the isolation tool 100 is pressurized to seal against the wall of the wellbore 9, where the wall is typically an inside surface of a metal casing string. With the isolation tool 100 sealed within the wellbore 6, the region of the wellbore above or uphole of the isolation tool 100 is fluidically isolated from the region of the wellbore below or downhole of the isolation 100. In FIG. 2C, the self-venting setting tool 90 has been disconnected from the isolation tool 100, the isolation tool 100 left in the wellbore 6 and the self-venting setting tool 90 removed from the wellbore 6.

Figure 3:
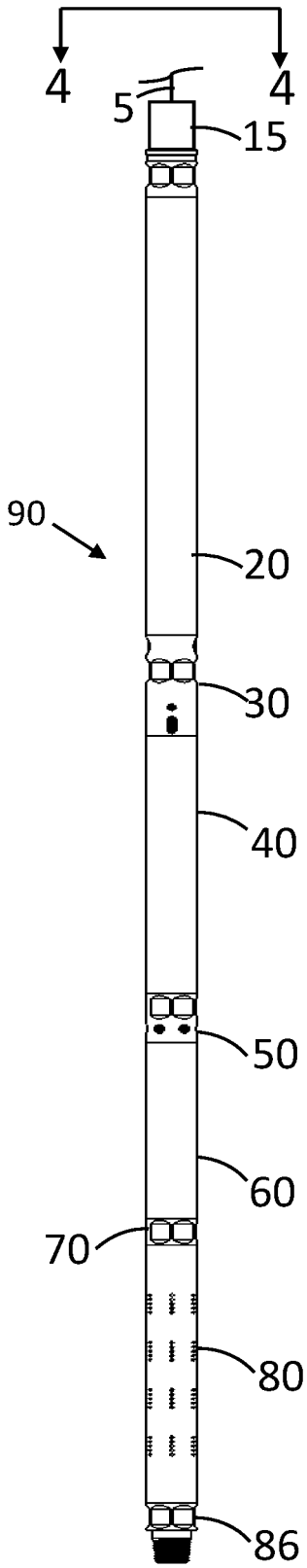
FIG. 3 is a view of the self-venting setting tool.
Figure 4:
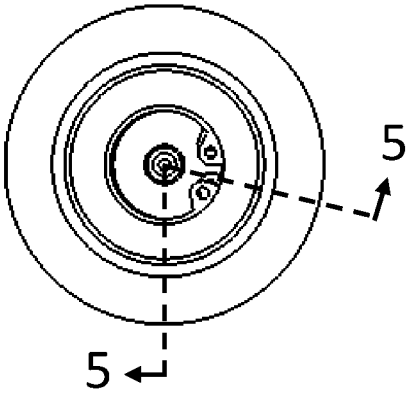
FIG. 4 is a top view of the self-venting setting tool from lines 4-4 of FIG. 3.
Figure 5A:
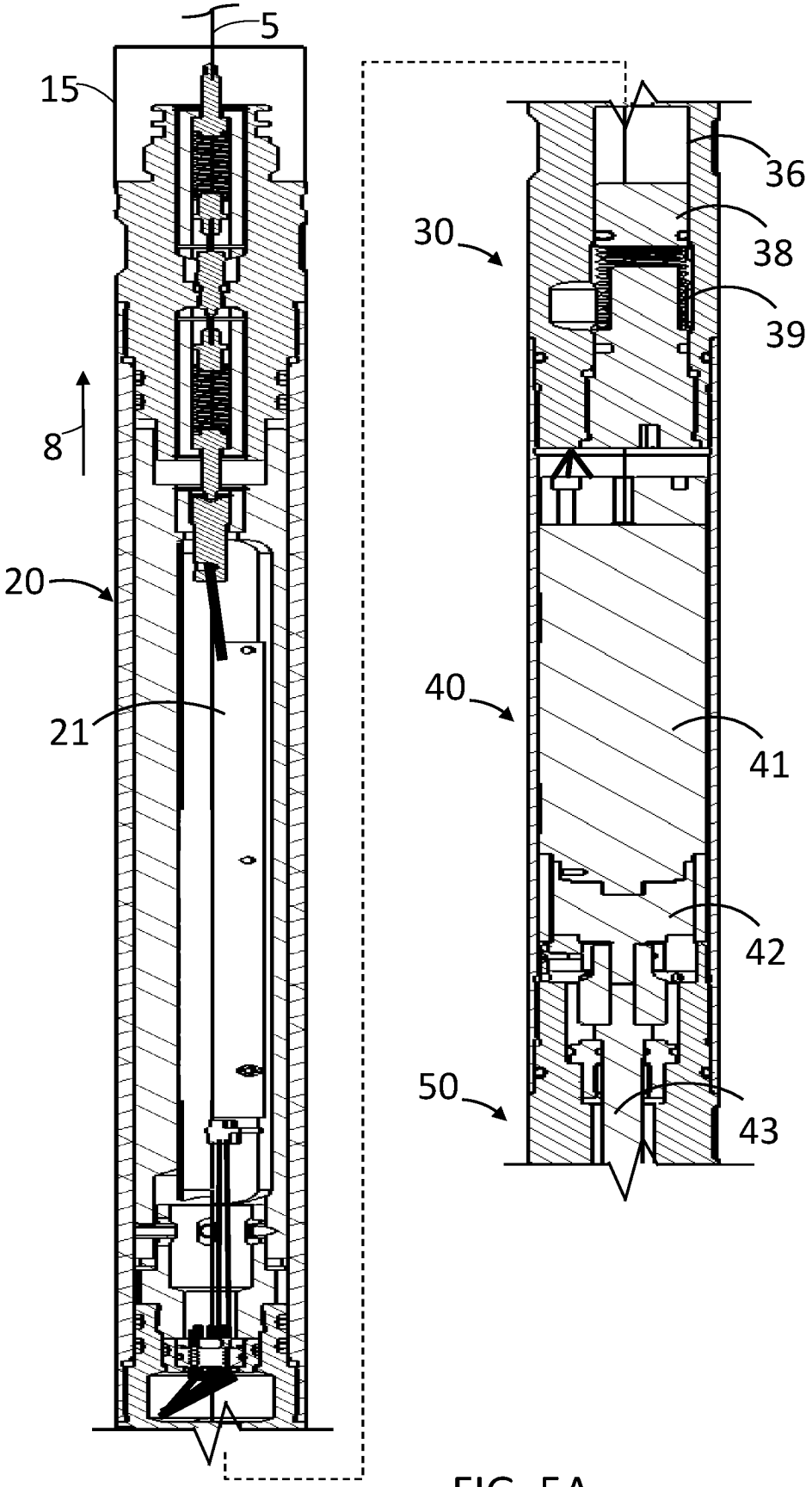
FIGS. 5A and 5B are cross-sectional partial views of the self-venting setting tool along line 5-5 of the FIG. 4.
Figure 5B:
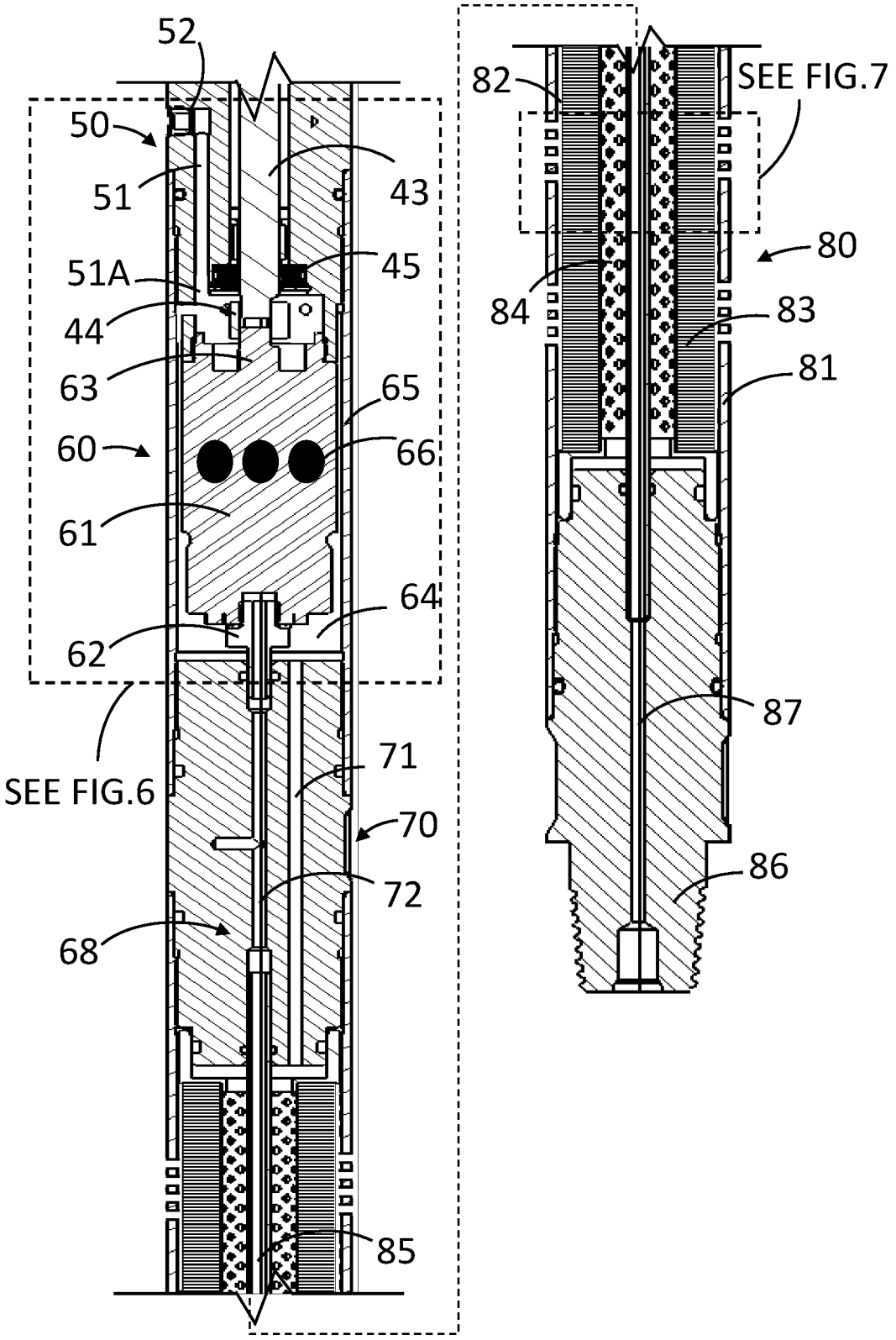

FIG. 5A-5B are cross-sectional partial views of an embodiment of a self-venting setting tool 90 along line 5-5 of FIG. 4 with a filter module as the fluid source module 80. FIG. 4 is a view of the self-venting setting tool 90 from line 4-4 of FIG. 3. The downhole tool 90 has a cable head 15 at its proximal (uphole) end for securing the wireline cable 5 (see also FIGS. 2A-2C). The wireline cable 5 may include a physical support line, an electrical power supply line, and a data communication line. The physical support line, such as a braided metal cable, may terminate at the cable head 15, but the electrical power supply line and data communication line extend through the cable head 15 to a control module 20 which is comprised of a controller 21 in electronic communication with a power module 40 mounted below the control module 20 and a compensator module 30. The power module 40 comprises an electrical motor 41 and a speed reducing gearbox 42. The controller module 20 is disposed to receive a current signal form the electrical motor 41 and to send a control signal to the electrical motor 41. The electrical motor 41 is disposed to transmit mechanical power to the speed reducing gearbox 42. The speed reducing gearbox 42 is disposed to transmit rotational mechanical power to the transmission shaft 43, which extends out of the power module 40, into and through a drive sub 50 to the pump module 60. The transmission shaft 43 additionally extends through a rotary seal 45 which retains oil within the uphole power module 40 and compensator module 30. The shaft 63 of pump 61 is coupled to the transmission shaft 43 with coupler 44. The pump 61 of the pump module 60 resides in the pump intake chamber 64 and inside the pump module housing 65 of the pump module 60.

Figure 6:
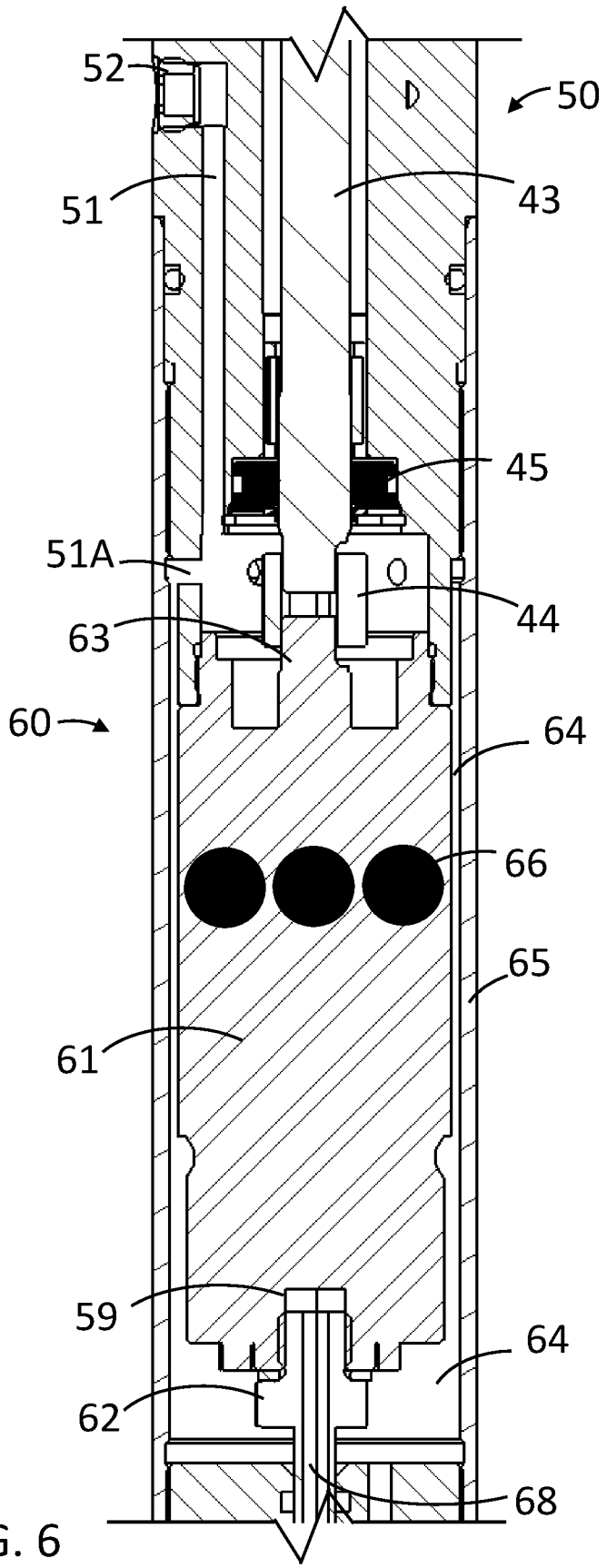
FIG. 6 is close-up view of a portion of FIG. 5B, the pump module and part of the drive sub, indicated on FIG. 5B.

The drive sub 50 is mechanically secured to the uphole end of the pump module 60 pump housing 65, secures the pump 61 and provides one or more fluid communication passageways, vent passageways 51, from the pump intake chamber 64 to the wellbore. See also FIG. 6. Each of one or more vent passageway's intake 51A from the pump intake chamber 64, is preferably located uphole from the pump intake ports 66.

A fluid control device 52 resides along the vent passageway to control fluid passing therethrough, to and from the self-venting setting tool 90.

In an embodiment, the fluid control device 52 may control the physical properties of fluid entering the self-venting setting tool 90, for example, the size or amount of solids which may be inside the fluid entering the self-venting setting tool 90.

A mesh screen 52 resides along the vent passageways such that the size of particulates which may enter the pump intake chamber from the wellbore is controlled. The mesh screen is preferably sized to allow gas to escape from the pump intake chamber 64, through the vent passageways 51, to the wellbore.

Figure 8A:
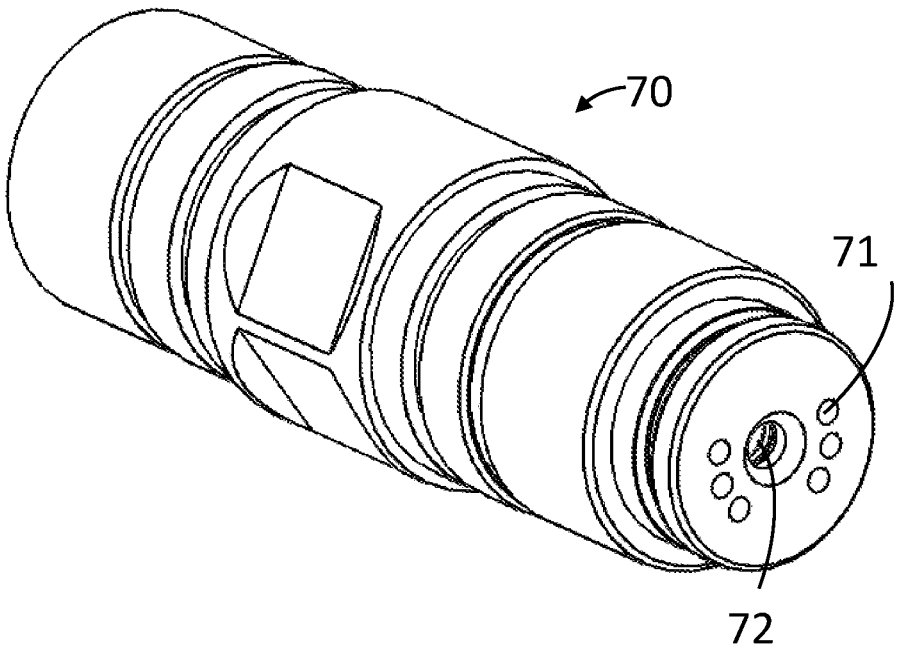
FIG. 8A is a view of the intake sub.
Figure 8B:
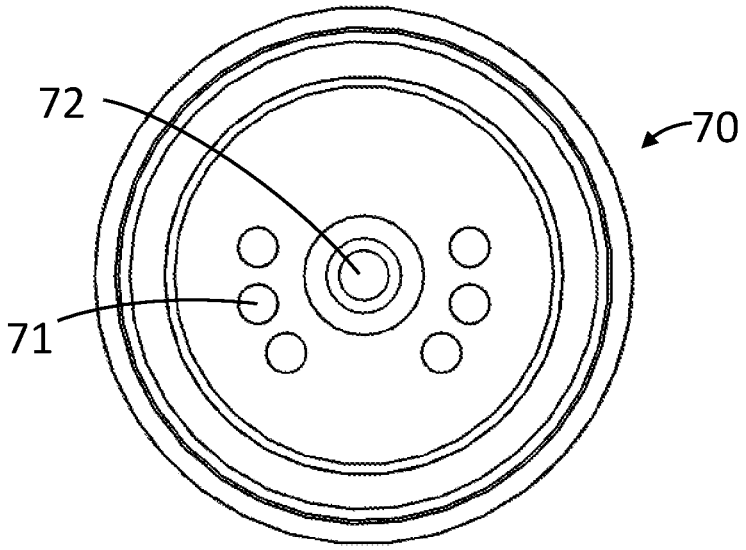
FIG. 8B is a top view of the intake sub.

See also FIGS. 8A and 8B. The intake sub 70 is mechanically secured to the downhole end of the pump module 60 and the uphole end of the fluid source module 80 and provides one or more fluid communication passageways, intake passageways 71, therethrough. A pump adapter 62 is secured and sealed to the pump output 59 and a central through hole 72 of intake sub 70.

Figure 7:
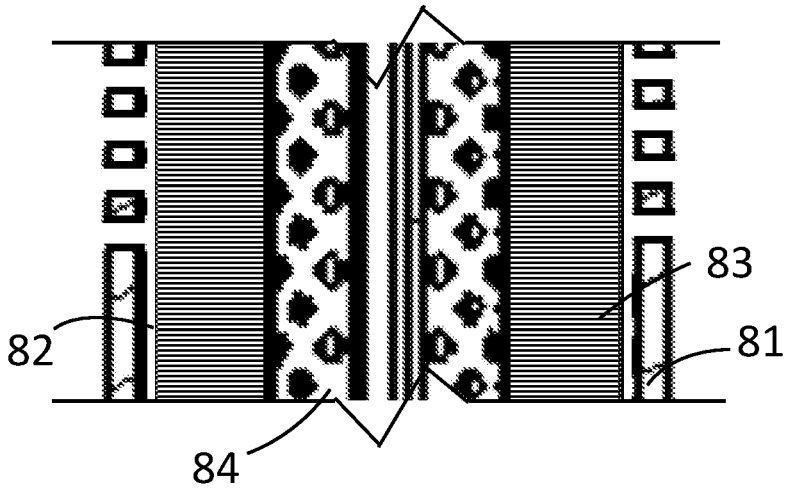
FIG. 7 is close-up view of a portion of FIG. 5B, part of the filter module indicated on FIG. 5B.
Figure 20A:
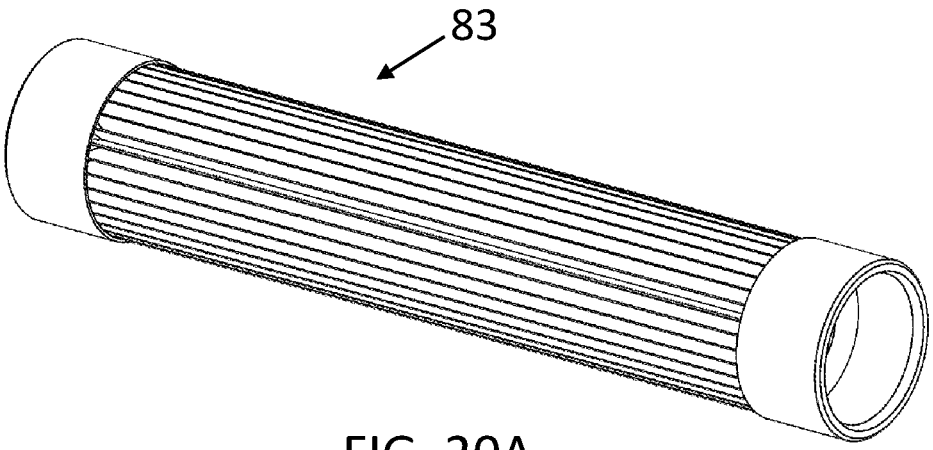
FIG. 20A is a view of a filter cartridge.
Figure 20B:
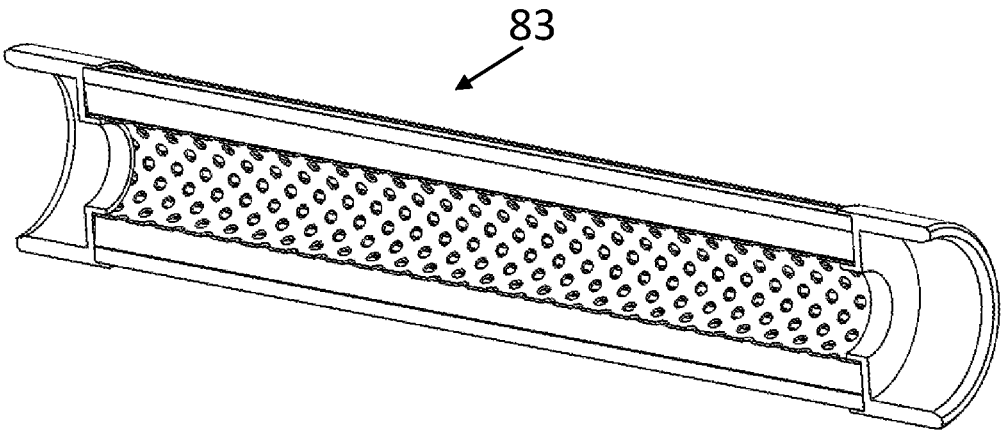
FIG. 20B is a section view of a filter cartridge.

See also FIG. 7. In an embodiment, the fluid source module 80 is a filter module and is secured to the lower end of the intake sub 70. The filter module 80 comprises a ported housing 81, to allow wellbore fluid to flow through, enter a first volume being an outer annular fluid volume 82, and flow through a filter cartridge 83 to second volume being an inner annular volume 84 in fluid communication with the pump intake chamber 64 by means of intake passageways 71. See also FIG. 20A-20B. A bottom sub 86 is secured to the lower end of the ported housing 81 and a flow through tube 85 extends from the intake sub 70, to the bottom sub 86. A continuous hydraulic flow path; output hydraulic passageway 68, which may also be known as the output side of the self-venting setting tool, extends from the pump output out the downhole end of the bottom sub 86 and is comprised of a through hole in the pump adapter 62, passage 72 of the intake sub, flow through tube 85 and a through hole 87 through the bottom sub.

With reference to FIG. 5A, the compensator module 30 comprises a compensator piston 38 spring loaded by spring 39 and disposed to translate within compensator bore 36. A volume on the downhole side of the compensator piston 38 is in fluid communication with the tool exterior; for example, the wellbore 6, and a hydraulic fluid volume on the uphole side of the compensator piston 38 is in fluid communication with the interior of the power module 40 and the interior volume of the drive sub 50 in which the transmission shaft 43 resides.

Figure 9:
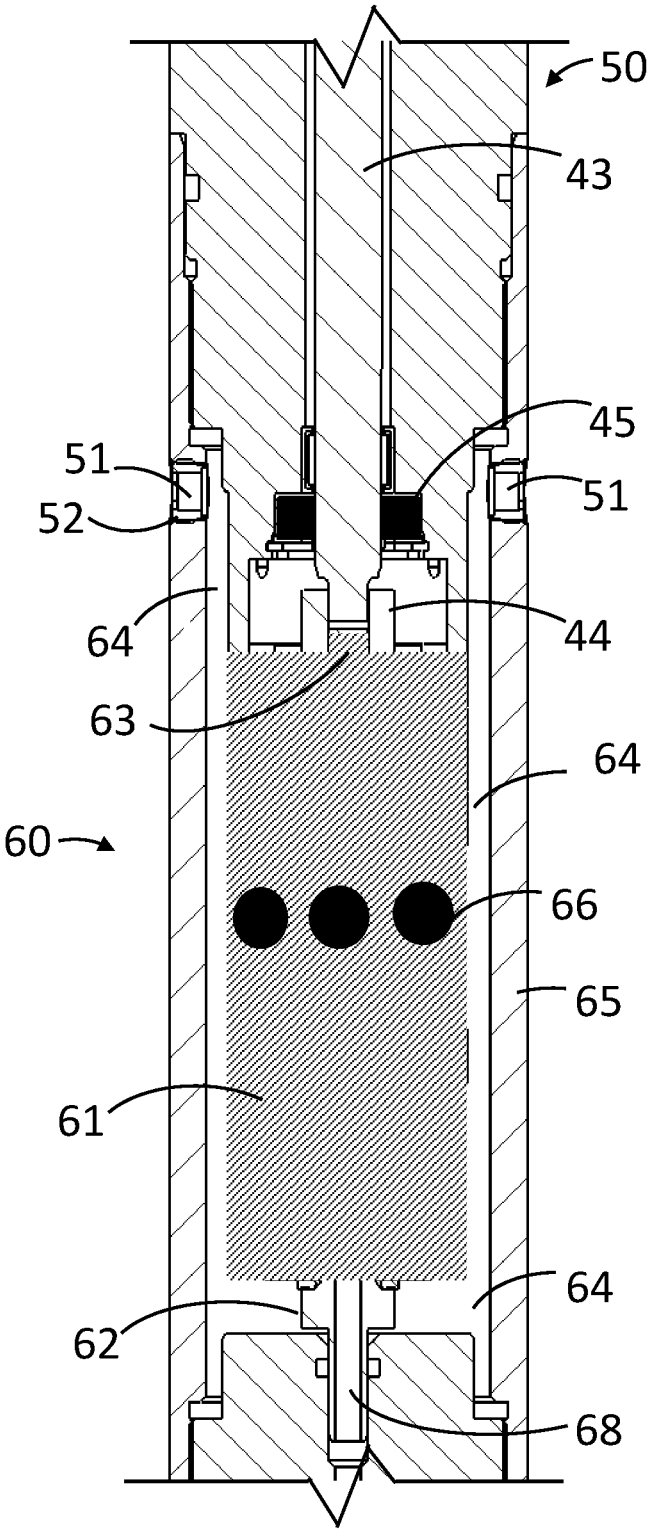
FIG. 9 is a partial section view of an embodiment of a self-venting setting tool predominantly showing the pump module.

FIG. 9 is a partial section view of an embodiment of a self-venting setting tool. In this embodiment, the drive sub 50 is void of vent passageways and alternatively the pump module housing 65 comprises one or more vent passageways 51 uphole from the pump intake ports 66.

Figure 10:
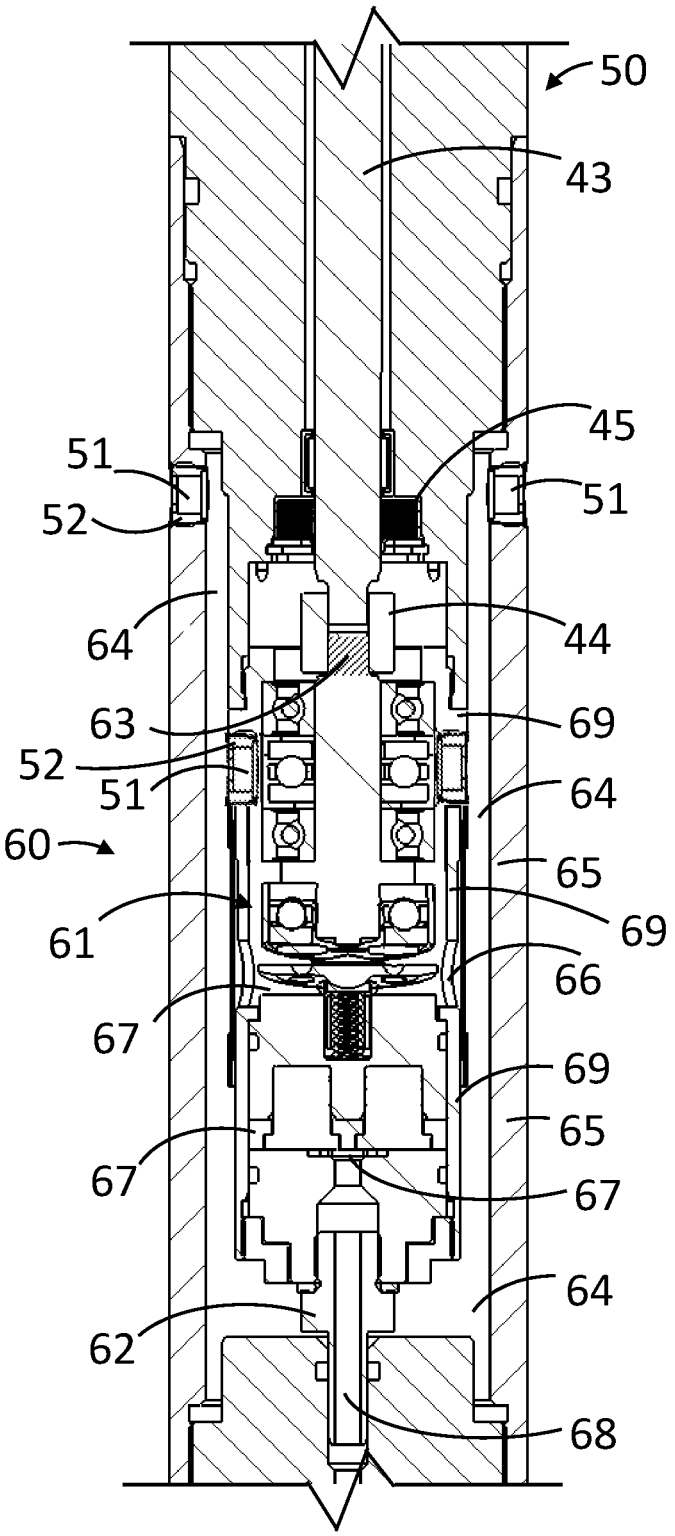
FIG. 10 is a partial section view of an embodiment of a self-venting setting tool predominantly showing the pump module.

FIG. 10 is a partial section view of an embodiment of a self-venting setting tool. In this embodiment, the pump housing 69 comprises one more vent passageways 51 disposed to vent gas from within the pump internal cavities 67 and output hydraulic passageway 68 to the pump intake chamber 64. The pump module is mechanically secured to a drive sub 50 on an uphole end and mechanically secured to the intake sub 70 on the downhole end, the pump 61 disposed to receive mechanical power from the power module 40 via transmission shaft 43.

Figure 11:
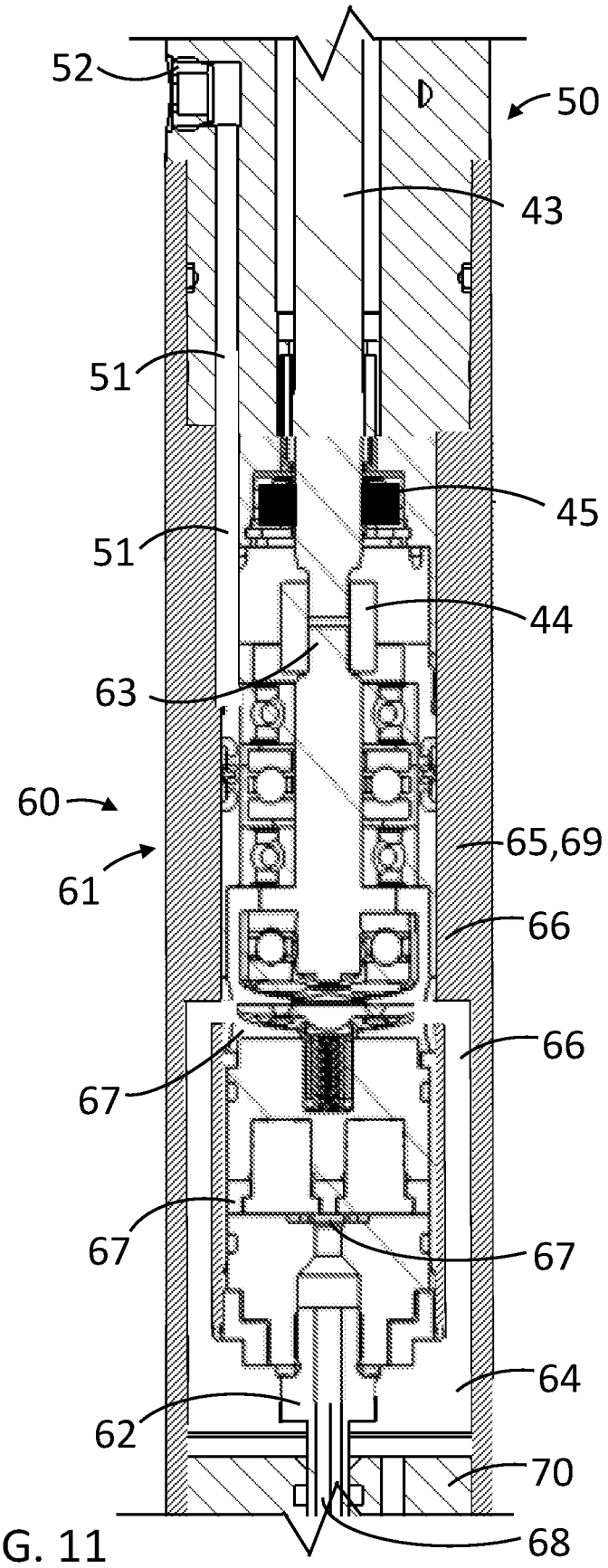
FIG. 11 is a partial section view of an embodiment of a self-venting setting tool predominantly showing the pump module.

FIG. 11 is a partial section view of an embodiment of a self-venting setting tool. In this embodiment, the pump module housing 65 is also the pump housing 69, the pump housing mechanically secured to a drive sub 50 on an uphole end comprising one or more vent passageways 51 and mechanically secured to the intake sub 70 on the downhole end, the pump 61 disposed to receive mechanical power from the power module 40 by transmission shaft 43.

Figure 12:
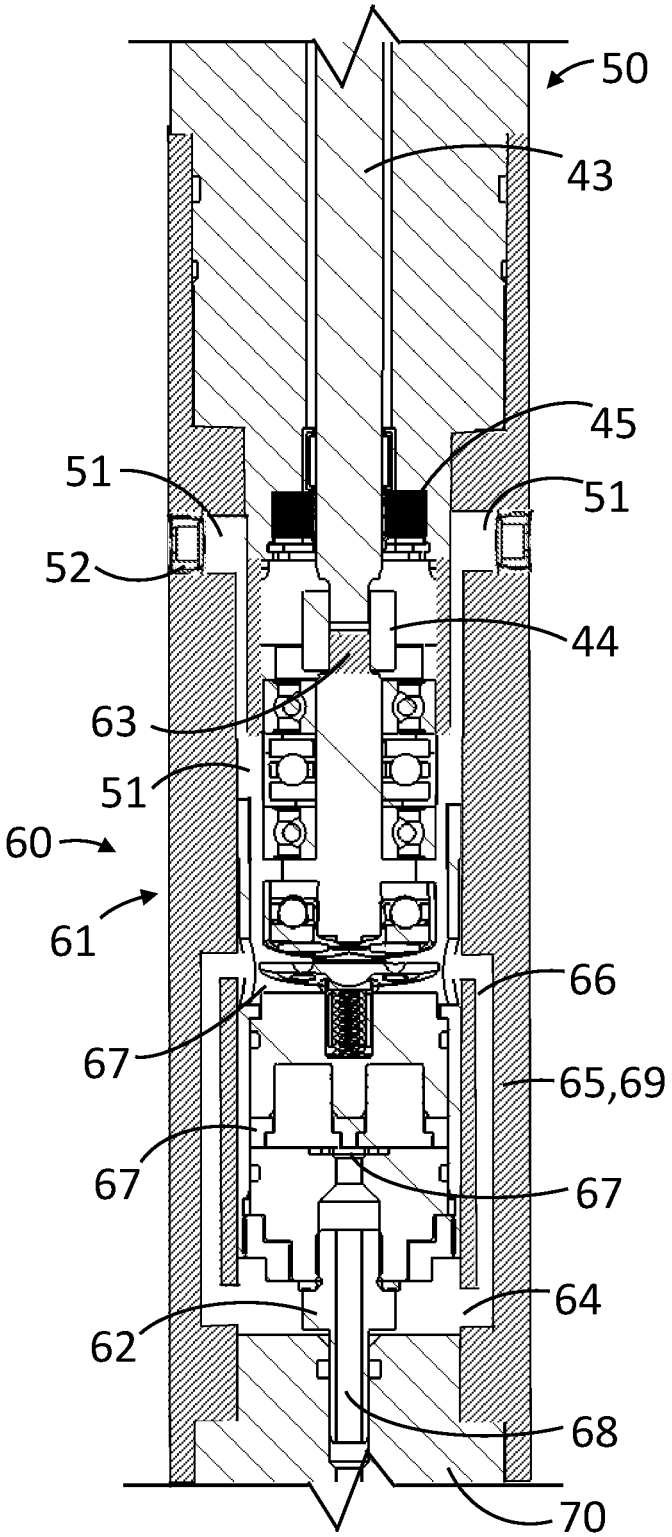
FIG. 12 is a partial section view of an embodiment of a self-venting setting tool predominantly showing the pump module.

FIG. 12 is a partial section view of an embodiment of a self-venting setting tool. In this embodiment, the pump module housing 65 is also the pump housing 69, the pump housing mechanically secured to a drive sub 50 on an uphole end and mechanically secured to the intake sub 70 on the downhole end, the pump 61 disposed to receive mechanical power from the power module 40. The drive sub is void of vent passageways and alternatively, the pump housing comprises one or more vent passageways 51.

Figure 13:
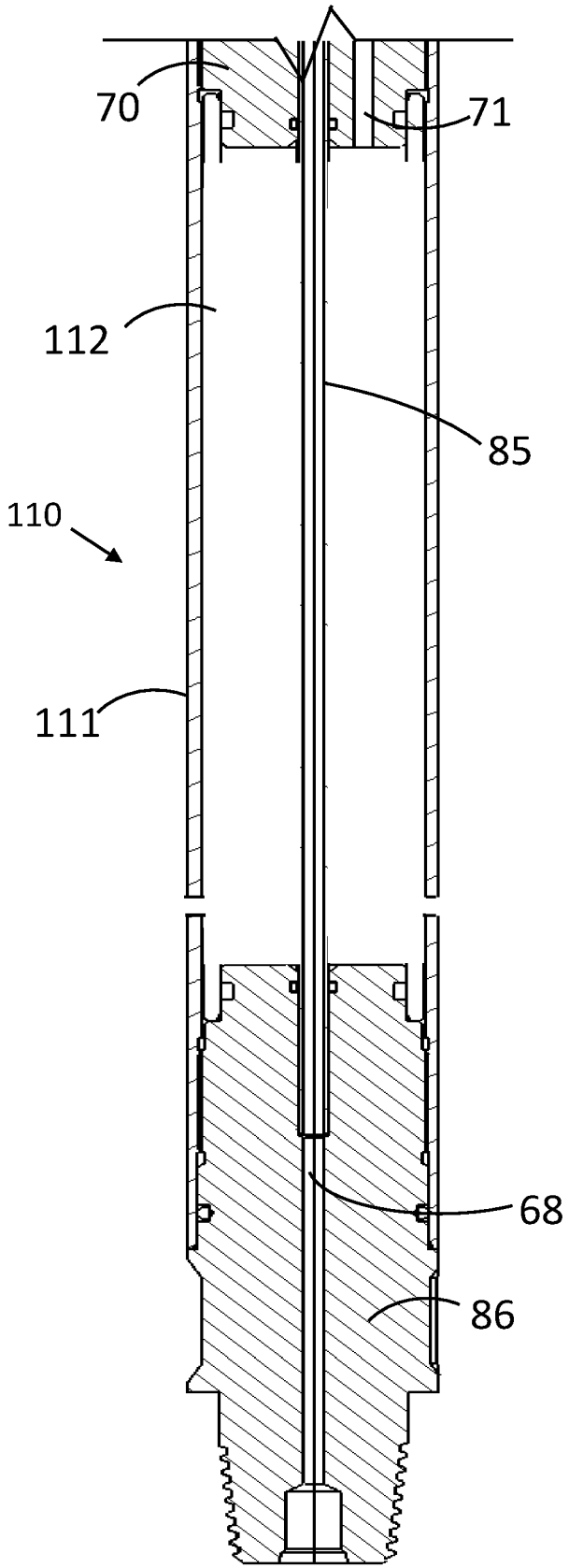
FIG. 13 is a partial section view of an embodiment of a self-venting setting tool predominantly showing a fluid source module.

Referring to FIG. 13, in an embodiment, the fluid source module is a ported module 110 comprising a ported housing 111, an inner fluid volume 112, a bottom sub 86 and a flow through tube 85 enabling fluid communication from the pump, through the ported module 110 and bottom sub 86.

Figure 14:
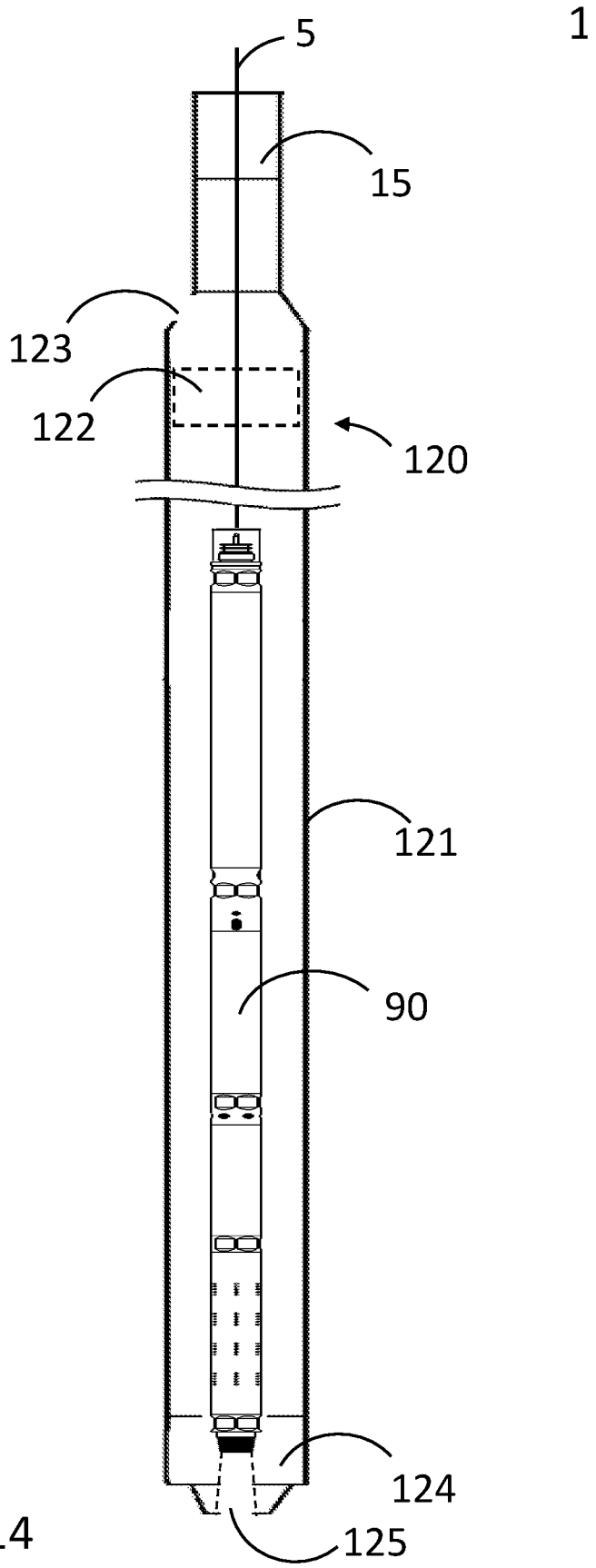
FIG. 14 is a schematic of an embodiment of a self-venting setting tool disposed within a fluid reservoir module.

Referring to FIG. 14, in an embodiment, the self-venting setting tool 90 is disposed in a fluid source module 120. The fluid source module in this embodiment is a reservoir module 120 comprising; a reservoir outer housing 121, a reservoir inner body 122 isolating reservoir fluid within the reservoir outer housing 121 filled prior to deployment, from well fluid allowed to communicate through one or more ports 123 in the reservoir outer housing 121. A bottom adapter 124 secures the reservoir outer housing 121 to the downhole end of the self-venting setting tool 90 and a provides a flow path 125 to and through the lower end of the reservoir module 120. As fluid is drawn into the pump intake chamber 64 by the pump 61 and pumped through the bottom adapter 124 of the reservoir module 120, pressure may act on the reservoir inner body 122 through the one or more ports 123 in the reservoir outer housing 121 to apply pressure to the pump intake chamber 64. Fluid may vent to the interior of the reservoir module 120 through the vent passageways 51.

In an embodiment of a BHA, an isolation tool is fluidically connected to the downhole end of the bottom adapter 124.

In an embodiment, a fluid control device 52 is included along one or more vent passageways 51.

Figure 15A:
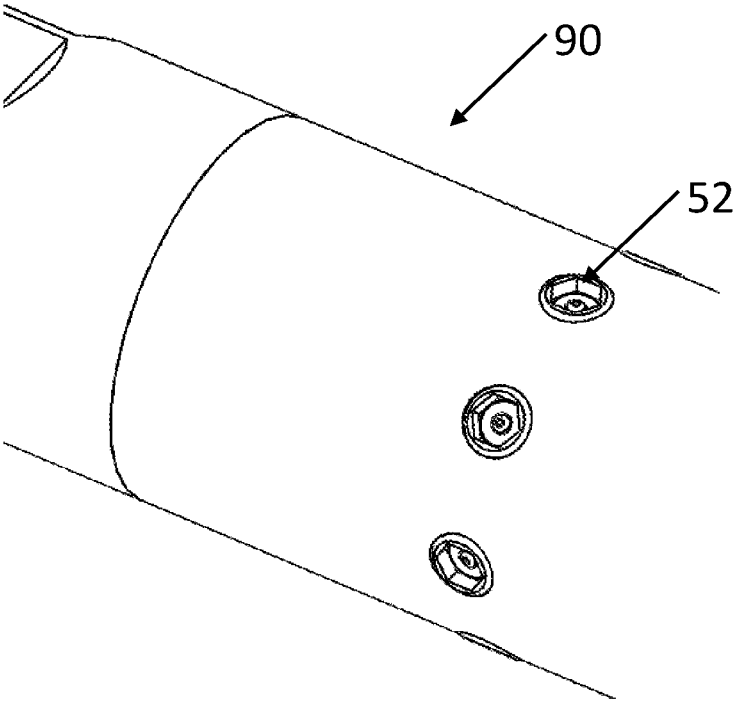
FIG. 15A is a partial view of a self-venting setting tool showing fluid control devices, membrane check valves installed.
Figure 15B:
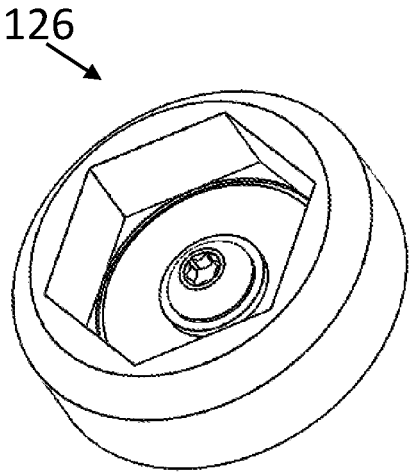
FIG. 15B is a view of a membrane check valve.
Figure 15C:
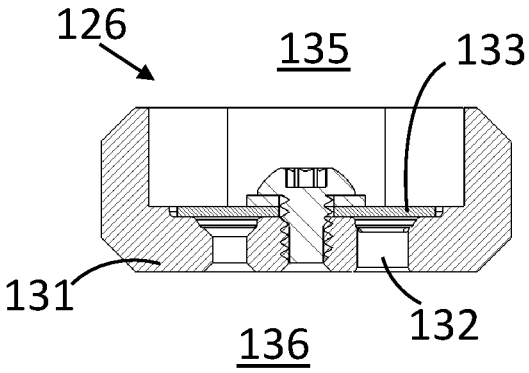
FIG. 15C is a section view of a membrane check valve.

FIG. 15A is a partial view of a self-venting setting 90 which shows fluid control devices 52 installed. FIG. 15B is a membrane check valve and FIG. 15C is a section view of a membrane check valve 126 comprising a valve body 131 including vent holes 132, a flexible membrane 133 centrally fastened to the valve body 131. When pressure exterior 135 to the membrane check valve 126 is greater than or equal to interior 136 pressure, the membrane 133 obstructs the passage of flow through the vent holes 132. When pressure exterior 135 to the membrane check valve 126 is less than the interior 136 pressure, the membrane 133 flexes toward the exterior 135 to allow the passage of flow through the vent holes 132.

In an embodiment, the fluid control device 52 is a membrane check valve 126.

Figure 16A:
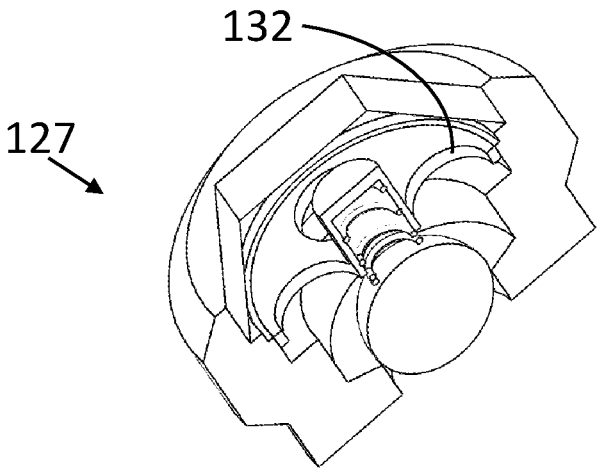
FIG. 16A is a view of a ball check valve.
Figure 16B:
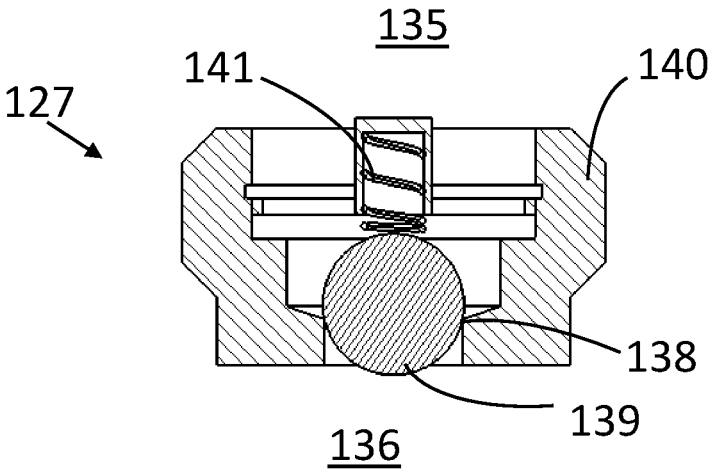
FIG. 16B is a section view of a ball check valve.

FIG. 16A is a ball check valve. FIG. 16B is a section view of a ball check valve 127 comprising a valve body 140 including vent holes 132, a ball 139, a ball seat 138 and a spring 141. When pressure on an exterior 135 to the ball check valve 127 is greater than or equal to the interior 136 pressure, the spring 141 ensures ball 138 obstructs the passage of flow through the vent holes 132. When pressure exterior 135 to the ball check valve 127 is less than the interior 136 pressure and the interior 136 applies sufficient force to overcome the force of the spring 141 acting on the ball 139, the ball 139 will move toward the exterior 135 to allow the passage of flow through the vent holes 132.

In an embodiment, the fluid control device 52 is a ball check valve 127.

Figure 17A:
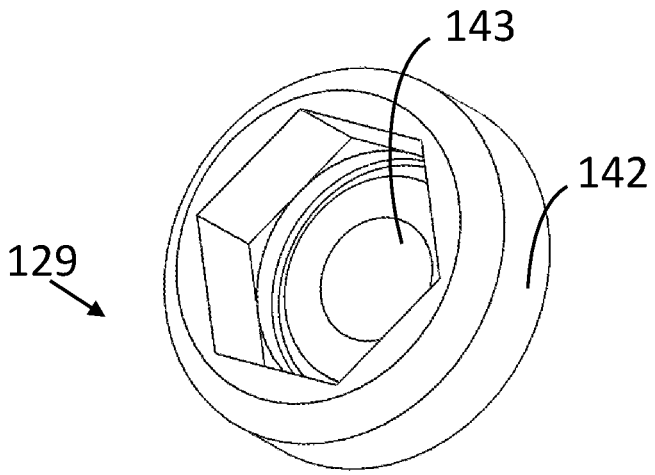
FIG. 17A is a view of an umbrella valve assembly.
Figure 17B:
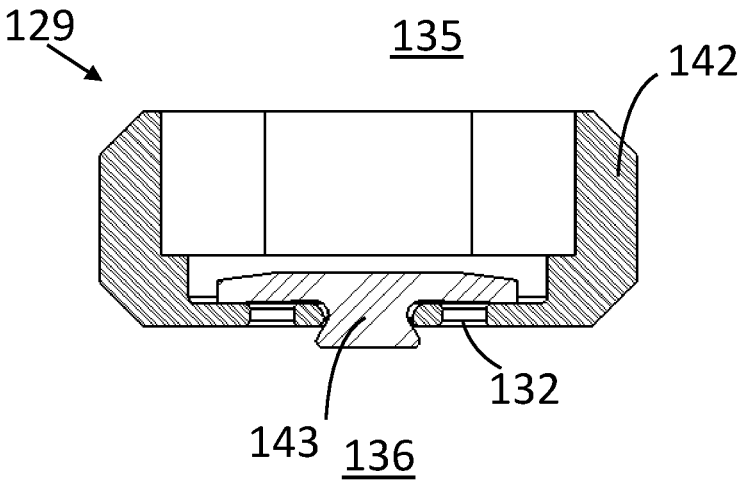
FIG. 17B is a section view of an umbrella valve assembly.

FIG. 17A is an umbrella check valve assembly 129 and FIG. 17B is a section view of the umbrella check valve assembly 129 comprising a valve body 142 including vent holes 132, an umbrella valve 143 centrally fastened to the valve body 142. When pressure exterior 135 to the umbrella valve 143 is greater than or equal to interior 136 pressure, the umbrella valve 143 obstructs the passage of flow through the vent holes 132. When pressure exterior 135 to the umbrella valve 143 is less than the interior 136 pressure, the umbrella valve 143 flexes toward the exterior 135 to allow the passage of flow through the vent holes 132.

In an embodiment, the fluid control device 52 is an umbrella valve assembly 129.

In an embodiment, the fluid control device 52 is an umbrella valve 129.

Figure 18A:
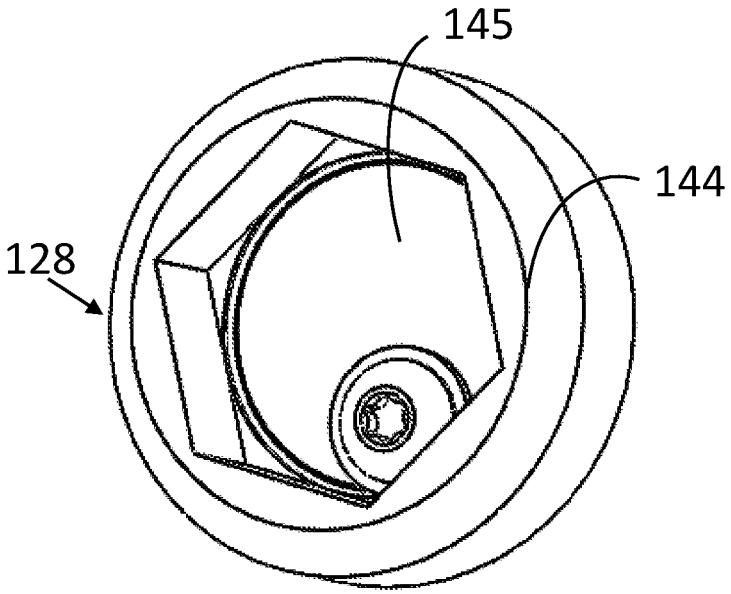
FIG. 18A is a view of a flapper valve.
Figure 18B:
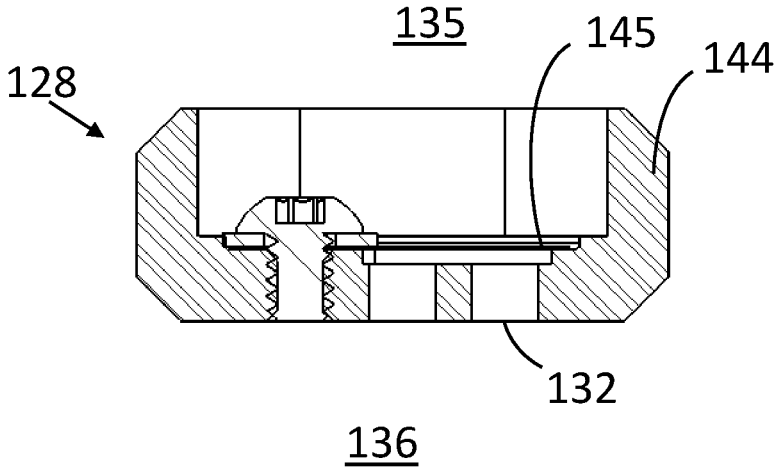
FIG. 18B is a section view of a flapper valve.

FIG. 18A is a flapper valve and FIG. 18B is a section view of a flapper valve 128 comprising a valve body 144 including vent holes 132, a flexible membrane 145 fastened on one side to the valve body 144. When pressure exterior 135 to the flapper valve 128 is greater than or equal to interior 136 pressure, the flexible membrane 145 obstructs the passage of flow through the vent holes 132. When pressure exterior 135 to the flapper valve 128 is less than the interior 136 pressure, the flexible membrane 145 flexes toward the exterior 135 to allow the passage of flow through the vent holes 132.

In an embodiment, the fluid control device 52 is a flapper valve 128.

Figure 19A:
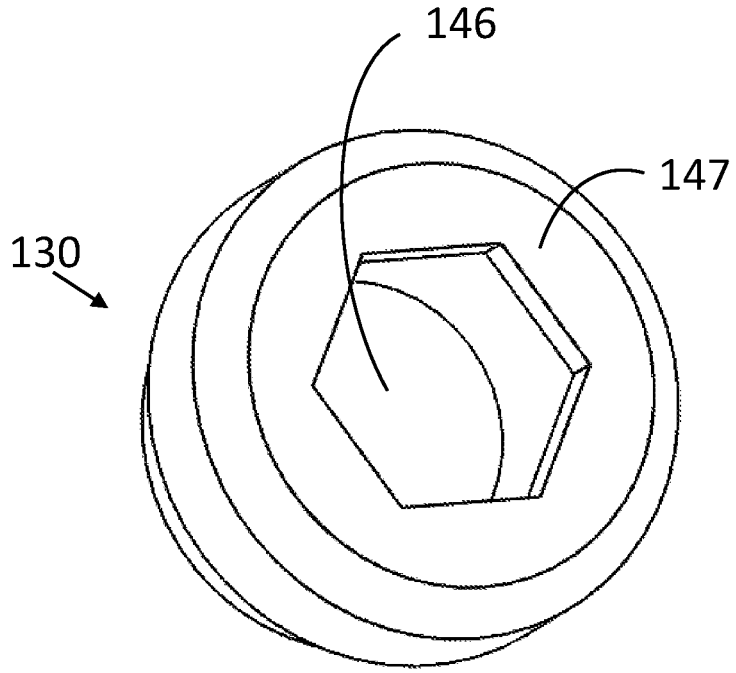
FIG. 19A is a view of a screen insert.
Figure 19B:
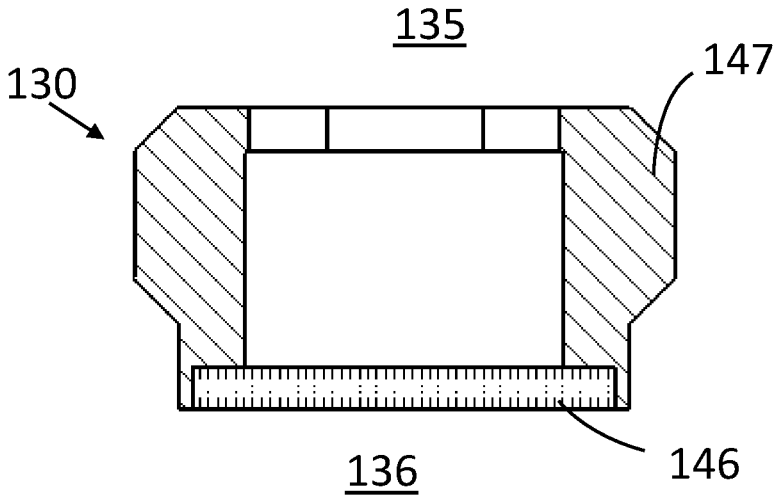
FIG. 19B is a section view of a screen insert.

FIG. 19A is a screen insert. FIG. 19B is a section view of a screen insert 130 comprising a screen insert body 147 and a screen 146 which controls the size of a particulate within a fluid passing therethrough.

In an embodiment, the screen 146 mesh size is selected to control the size of a particulate within a fluid passing therethrough which is tolerable and able to be pumped by pump 61.

In an embodiment, the fluid control device 52 is a screen insert 130.

In an embodiment, the fluid control device is a screw having one or more ports or through-holes, the screw threaded into the pump module housing 65, the drive sub 50 or the pump housing.

When the self-venting setting tool is submerged in well-fluid from a gas environment, well-fluid flows into the filter module 80 through the ported housing 81, into annular fluid volume 82, through the cartridge filter 83 to inner annular volume 84, through the intake passageways 71 of intake sub 70, into pump intake chamber 64, and into pump 61 through pump ports 66.

An embodiment provides a method of delivering fluid out of a self-venting setting tool 90, the method comprising: exposing the self-venting setting tool 90 to a fluid pressure; displacing gas within a fluid source module 80, one or more intake passageways 71, a pump intake chamber 64, one or more internal pump cavities 67, generally, an intake side of the self-venting setting tool, by venting gas residing therein, through one or more vent passageways 51 to a wellbore 6 such that when the self-venting setting tool 90 is activated, the pump 61 draws in fluid from a fluid source module 80 and delivers it to the output hydraulic passageway 68 which extends out the downhole end of the self-venting setting tool 90; activating the self-venting setting tool 90; delivering fluid out of the self-venting setting tool 90.

In an embodiment, the vent passageways are in fluid communication with the wellbore above the bottom hole assembly.

In an embodiment the method further comprises venting the output hydraulic passageway 68 of the self-venting setting tool 90.

Figure 21:
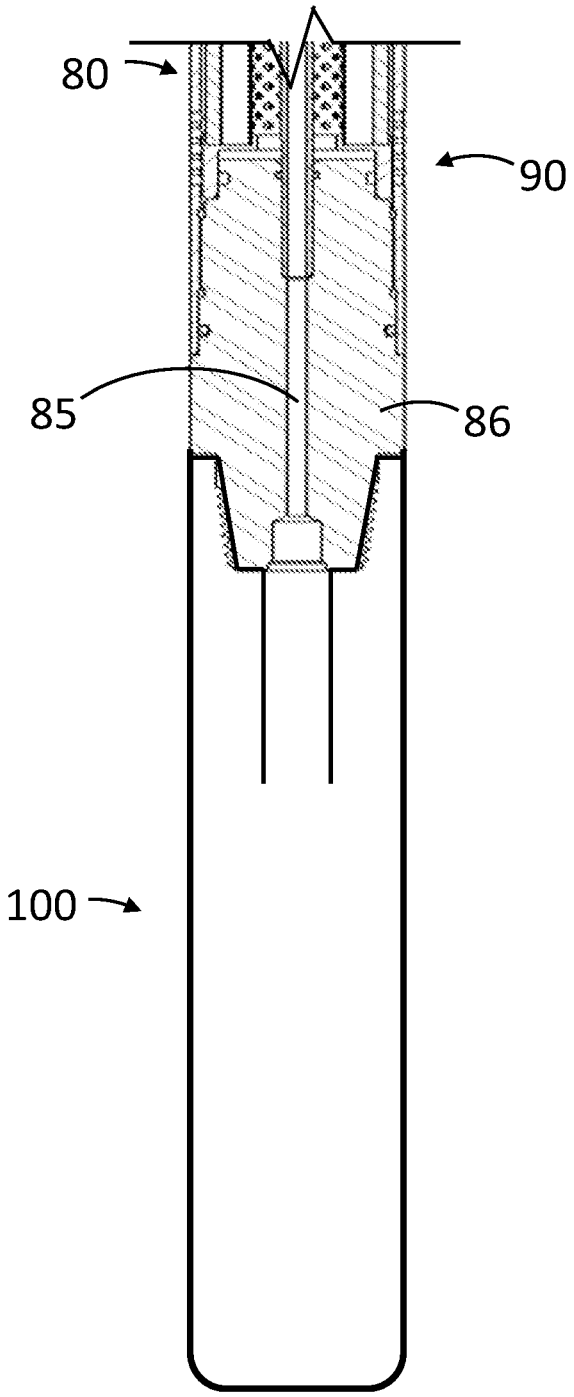
FIG. 21 is a partial view of a bottom hole assembly showing the lower end of a self-venting setting tool connected to an isolation tool.

In a further embodiment, there is provided a method of isolating a portion of a well bore, the method comprising the steps of: deploying the BHA 10 comprising the self-venting setting tool 90 and an isolation 100 tool on a wireline 5; exposing the self-venting setting tool 90 to the wellbore 6 fluid pressure, which may be during deployment into the wellbore 6, to sufficiently displace gas within a fluid source module 80, one or more intake passageways 71, a pump intake chamber 64, and internal pump cavities 67, the intake side of the self-venting setting tool, by venting gas therein through one or more vent passageways 51 to the wellbore 6; positioning the BHA 10 at a desired location in the wellbore 6; activating the self-venting setting tool 90 to provide fluid to the isolation tool 100; pressurizing the isolation tool 100 to engage the wellbore wall 9; isolating a portion of the wellbore 6 above the isolation tool 100 from a portion of the wellbore 6 below the isolation tool 100. See also FIG. 21.

In an embodiment, the method further comprises venting the output hydraulic passageway 68 of the self-venting setting tool 90.

In an embodiment of the method, the pump 61 is activated after displacing and venting gas within the intake passageway and some or all of the internal pump cavities 67, and prior to displacing and venting gas of the output hydraulic passageway 68.

In an embodiment, the method further comprises venting gas through one or more fluid control devices 52 disposed along the vent passageways 51.

In an embodiment of the method, gas is vented through one or more vent passageways 51 to the wellbore 6 by providing fluid from a fluid source module 80 to the output hydraulic passageway 68 after activation of the self-venting setting tool.

In an embodiment, the method further comprises disconnecting the self-venting setting tool 90 from the isolation tool 100 and removing the self-venting setting tool 90 from the wellbore.

In an embodiment, the isolation tool 100 is an inflatable packer.

In an embodiment, the isolation tool 100 is an inflatable plug.

In an embodiment, the isolation tool 100 is an inflatable straddle packer.

In an embodiment, the isolation tool 100 is a bridge plug.

In an embodiment, the isolation tool 100 is a production packer

In an embodiment, the isolation tool 100 is a permanent packer.

In an embodiment, the isolation tool 100 is a cement retainer.

In an embodiment, the isolation tool 100 is a frac plug.

The terminology used herein is for the purpose of describing particular embodiments only and is not intended to limit the scope of the claims. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the embodiment. The term "seal", as in the engaging of a sealing element to a wellbore, is used for the purpose of describing particular embodiments. The term "seal" should not be limited in scope to a perfect seal and may be a partial seal.

The corresponding structures, materials, acts, and equivalents of all means or steps plus function elements in the claims below are intended to include any structure, material, or act for performing the function in combination with other claimed elements as specifically claimed. Embodiments have been presented for purposes of illustration and description, but it is not intended to be exhaustive or limited to the embodiments in the form disclosed. Many modifications and variations will be apparent to those of ordinary skill in the art after reading this disclosure. The disclosed embodiments were chosen and described as non-limiting examples to enable others of ordinary skill in the art to understand these embodiments and other embodiments involving modifications suited to a particular implementation.

What is claimed is:

1. A wireline bottom hole assembly for use within a wellbore that extends into a subterranean formation, comprising a self-venting setting tool; the self-venting setting tool including:

a pump module having a pump, a pump intake port and a pump output;

a fluid source module disposed below the pump and in fluid communication with the wellbore above the bottom hole assembly, having a ported housing and a first fluid volume;

the pump intake port disposed to intake fluid from the fluid source module;

an electric motor operable to power the pump;

a vent passageway in fluid communication with the pump, having a vent passageway intake on an uphole side of the pump intake port and disposed to vent gas from the pump module to the wellbore above the pump;

an output passageway extending from the pump output, through the fluid source module.

2. The bottom hole assembly of claim 1, further comprising an isolation tool connected to the self-venting setting tool and disposed to receive fluid therefrom, via the output passageway.

3. The bottom hole assembly of claim 1, wherein the fluid source module is a filter module, the filter module further comprising:

a filter disposed interior the first fluid volume and the ported housing;

a second fluid volume within the filter, wherein the second fluid volume is in fluid communication with the pump intake port.

4. The bottom hole assembly of claim 1, wherein the output passageway comprises a flow-through tube enabling fluid communication from the pump, out of the downhole end of the fluid source module.

5. The bottom hole assembly of claim 1, additionally comprising a fluid control device disposed to control fluid through the vent passageway.

6. The bottom hole assembly of claim 1, wherein the pump is an axial displacement pump.

7. The bottom hole assembly of claim 1, wherein the electric motor receives electrical power through a wireline cable.

8. The bottom hole assembly of claim 1, further comprising:

a battery coupled to the electric motor for supplying electrical power to the electric motor.

9. The bottom hole assembly of claim 5, wherein the fluid control device is a mesh screen which may limit the size of a particulate in fluid flowing therethrough.

10. The bottom hole assembly of claim 5, wherein the fluid control device is a restrictor.

11. A method of delivering fluid out of the self-venting setting tool of claim 1, the method comprising:

deploying by wireline, a bottom hole assembly including the self-venting setting tool within a wellbore that extends into a subterranean formation;

exposing the self venting setting tool to wellbore fluid pressure within the wellbore above atmospheric pressure;

displacing gas within an intake side of the self-venting setting tool;

venting the displaced gas through one or more vent passageways to the wellbore;

activating the pump;

the pump intaking fluid from a fluid source in fluid communication with the wellbore.

12. The method of claim 11, wherein gas is additionally displaced within an output side of the downhole tool.

13. The method of claim 11, wherein the gas is displaced with fluid from the fluid source module in fluid communication with the wellbore.

14. The method of claim 12, wherein the pump is activated after displacing gas within the intake side of the downhole tool and prior to displacing and venting gas from the output side of the downhole hole tool.

15. The method of claim 12, wherein the pump is activated after displacing and venting gas from within the intake side and output side of the downhole tool.

16. The method of claim 12, further comprising: venting gas through one or more fluid control devices disposed along the vent passageways.

17. The method of claim 11, wherein the fluid source includes a ported housing, a filter and a fluid volume;

the fluid volume in fluid communication with the pump, and the wellbore above the bottom hole assembly through the filter and the ported housing.

18. A method of isolating a portion of a wellbore, the method comprising:

deploying the bottom hole assembly of claim 2 into the wellbore;

exposing the self-venting setting tool to wellbore fluid pressure to displace gas within an intake side of the self-venting setting tool venting the gas through one or more vent passageways to the wellbore;

positioning the bottom hole assembly at a desired location in the wellbore;

activating the self-venting setting tool to provide fluid to the isolation tool;

pressurizing the isolation tool to engage the wellbore wall;

isolating a portion of the wellbore above the isolation tool from a portion of the wellbore below the isolation tool.

19. The method of claim 18, further comprising: venting gas through one or more fluid control devices disposed along the one or more vent passageways.

20. The method of claim 18, wherein the self-venting setting tool is activated after displacing and venting gas within the intake side of the self-venting setting tool to the wellbore.

* * * * *